US009830813B2

(12) United States Patent
Smith et al.

(10) Patent No.: US 9,830,813 B2
(45) **Date of Patent: *Nov. 28, 2017**

(54) SMART AND SCALABLE URBAN SIGNAL NETWORKS: METHODS AND SYSTEMS FOR ADAPTIVE TRAFFIC SIGNAL CONTROL

(71) Applicant: CARNEGIE MELLON UNIVERSITY, a Pennsylvania Non-Profit Corporation, Pittsburgh, PA (US)

(72) Inventors: Stephen F. Smith, Cheswick, PA (US); Gregory J. Barlow, Pittsburgh, PA (US); Xiao-Feng Xie, Pittsburgh, PA (US)

(73) Assignee: CARNEGIE MELLON UNIVERSITY, a Pennsylvania Non-Profit Corporation, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/880,949

(22) Filed: Oct. 12, 2015

(65) Prior Publication Data

US 2016/0042641 A1 Feb. 11, 2016

Related U.S. Application Data

(63) Continuation-in-part of application No. 14/308,238, filed on Jun. 18, 2014, now Pat. No. 9,159,229.

(Continued)

(51) Int. Cl.

| | |
|---|---|
| ***G08G 1/07*** | (2006.01) |
| ***G08G 1/01*** | (2006.01) |
| ***G08G 1/08*** | (2006.01) |

(52) U.S. Cl.

CPC ..... *G08G 1/0116* (2013.01); *G08G 1/0133* (2013.01); *G08G 1/0145* (2013.01); *G08G 1/08* (2013.01)

(58) Field of Classification Search

CPC ..... G08G 1/0116; G08G 1/08; G08G 1/0145; G08G 1/0133; G08G 1/081; G08G 1/07; G08G 1/095; G08G 1/0075; G04F 10/04

(Continued)

(56) References Cited

U.S. PATENT DOCUMENTS 6,339,383 B1 * 1/2002 Kobayashi ..... G08G 1/164 340/907

6,587,778 B2 * 7/2003 Stallard ..... G08G 1/01 340/901

(Continued)

OTHER PUBLICATIONS

Xiao-Feng Xie, Stephen F. Smith, Ting-Wei Chen, Gregory J. Barlow, Real-time traffic control for sustainable urban living, 6 pages, Oct. 8, 2014, IEEE International Conference on Intelligent Transportation Systems (ITSC), Qingdao, China. http://dx.doi.org/10.1109/ITSC.2014.6957964.†

(Continued)

*Primary Examiner* — Anh V La

(74) *Attorney, Agent, or Firm* — David G. Oberdick; Michael G. Monyok

(57) ABSTRACT

Scalable urban traffic control system has been developed to address current challenges and offers a new approach to real-time, adaptive control of traffic signal networks. The methods and system described herein exploit a novel conceptualization of the signal network control problem as a decentralized process, where each intersection in the network independently and asynchronously solves a single-machine scheduling problem in a rolling horizon fashion to allocate green time to its local traffic, and intersections communicate planned outflows to their downstream neigh- (Continued)

bors to increase visibility of future incoming traffic and achieve coordinated behavior. The novel formulation of the intersection control problem as a single-machine scheduling problem abstracts flows of vehicles into clusters, which enables orders-of-magnitude speedup over previous time-based formulations and is what allows truly real-time (second-by-second) response to changing conditions.

3 Claims, 20 Drawing Sheets

Related U.S. Application Data

(60) Provisional application No. 61/956,833, filed on Jun. 18, 2013.

(58) Field of Classification Search
USPC ..... 340/922, 917, 907, 909–913
See application file for complete search history.

(56) References Cited

U.S. PATENT DOCUMENTS 9,076,332 B2 * 7/2015 Myr ..... G08G 1/04
9,159,229 B2 * 10/2015 Xie ..... G08G 1/08

OTHER PUBLICATIONS

Xiao-Feng Xie, Stephen F. Smith, Gregory J. Barlow, Ting-Wei Chen, Coping with real-world challenges in real-time urban traffic control, 16 pages, Jan. 12, 2014, Transportation Research Board (TRB) Annual Meeting, Washington, DC, USA. http://trid.trb.org/view.aspx?id=1288134.†

J. L. Farges, I. Khoudour, J. B. Lesort, Prodyn: on site evaluation, 5 pages, May 1, 1990, IET International Conference on Road Traffic Control, London, UK. http://ieeexplore.ieee.org/xpl/login.jsp?tp=&arnumber=114379.†

* cited by examiner
† cited by third party

| Label | Data Description | Origin | Destination |
|---|---|---|---|
| **SA-I1** | [Controller State Data] | Controller | Scheduler |
| **SA-I2** | [Local Detection Data] | Sensors | Scheduler |
| **SA-I3** | [Upstream Detection Data] | Upstream Neighbors | Scheduler |
| **SA-I4** | [Upstream Outflow Data] | Upstream Neighbors | Scheduler |
| **SA-O1** | [Extension Decision $ext$] | Scheduler | Controller |
| **SA-O2** | [Outflow Data] | Scheduler | Downstream Neighbors |
| **SA-M1** | [Exit Detection Data] | Sensors | Downstream Neighbors |

| In the Road Network |
|---|
| **SA-O2** is the source of **SA-I4** for the downstream neighboring intersections |
| **SA-M1** is the source of **SA-I3** for the downstream neighboring intersections |

FIG. 8

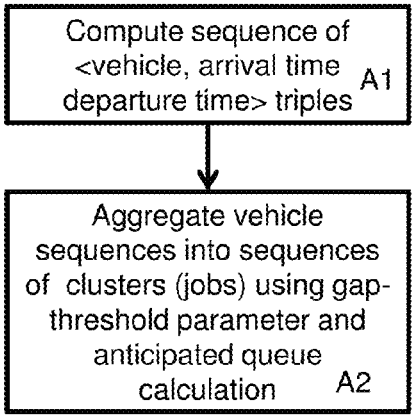

STEP A1:

INPUTS:

•Stop Bar (presence) and advance detector readings (vehicle counts at fixed distance over time)

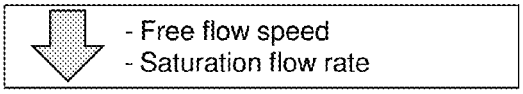

OUTPUTS:

•East-Approach: (<veh1, current-time, t1>, <veh2, t3, t4>, <veh3, t5, t6>, <veh4, t9, t10>)

•West Approach: (<veh5, t2, t3>, <veh6, t7, t8> <veh7, t11, t12>

STEP A2:

INPUTS:

•East-Approach: (<veh1, current-time, t1>, <veh2, t3, t4>, <veh3, t5, t6>, <veh4, t9, t10>)

•West Approach: (<veh5, t2, t3>, <veh6, t7, t8> <veh7, t11, t12>

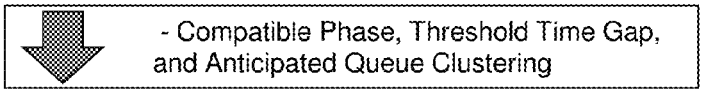

OUTPUTS:

•InFlow-EW: (<{veh1,veh5,veh2}, current-time, t4>, <{veh3},t5,t6>, <{veh6,veh4,veh7}, t7, t12>

(i.e., 7 perceived vehicles are aggregated into a sequence of 3 "jobs")

FIG. 13B

SMART AND SCALABLE URBAN SIGNAL NETWORKS: METHODS AND SYSTEMS FOR ADAPTIVE TRAFFIC SIGNAL CONTROL

CROSS-REFERENCE TO RELATED APPLICATIONS

This application is a Continuation-in-Part Application that claims the benefit of U.S. application Ser. No. 14/308,238, filed Jun. 18, 2014, which, in turn, claims the benefit of US Provisional Application Ser. No. 61/956,833, titled SMART AND SCALABLE URBAN SIGNAL NETWORKS: METHODS AND SYSTEMS FOR ADAPTIVE TRAFFIC SIGNAL CONTROL, filed Jun. 18, 2013, both incorporated by reference herein.

BACKGROUND

Traffic congestion in urban road networks is a substantial problem, resulting in significant costs for drivers through wasted time and fuel, detrimental impact to the environment due to increased vehicle emissions, and increased needs for infrastructure upgrades. Poorly timed traffic signals are one of the largest recurring sources of traffic congestion. Even when signals have been recently retimed, the inability to respond to current traffic patterns can cause pockets of congestion that lead to larger traffic jams. Inefficiencies in traffic signal timing stem from poor allocation of green time, inability to respond to real-time conditions, and poor coordination between adjacent intersections.

Operation of the traffic signals at a given intersection is typically governed by a signal timing plan. A timing plan assumes that compatible vehicle movement paths through the intersection (e.g., north and south lanes) have been grouped into movement phases. It specifies the sequence in which phases should be activated (turned green) and the duration of each green phase. The duration of each phase is subject to minimum and maximum constraints to ensure fairness and the transition from one phase to the next must obey safety constraints (fixed-length yellow and all red periods). A timing plan is graphically depicted in FIG. 1.

Conventional signal systems use pre-programmed timing plans to control traffic signal operation. Fixed timings allocate fixed cycle lengths and green splits, while actuated signals use vehicle detectors to allow simple, minor variations in phase durations within the constraints of the timing plan (e.g., the green may be indefinitely allocated to the dominant traffic flow, only shifting to a cross street phase when a waiting vehicle is detected). For coordinated plans, lights often operate in a common cycle length, and offsets are set for coordinated phases between neighbors, on predefined corridors. Different timing plans may be invoked at different periods of the day (e.g., during rush and off-peak periods), and the timing plans can impose additional constraints to coordinate the actions of signals at different intersections. The crucial distinction is that timing and coordination plans are computed off-line, based on expected traffic conditions. Adaptive signal systems, in contrast, sense the actual traffic flows approaching intersections and continually adjust intersection timing plans to match current conditions.

The design of adaptive signal systems has received considerable attention over the years, and it is generally recognized that traffic signal improvements offer the biggest payoff for reducing congestion and increasing the effective capacity of existing road networks, and that adaptive traffic signal control systems hold the most promise for improvement. With respect to the control of traffic signal networks, most practical success has been achieved using more centralized approaches (e.g., SCATS, SCOOT, ACS-Lite) that adjust the three fundamental parameters, cycle length, phase split, and offset, for traffic lights. Due to the rather strong restriction imposed on parametric adjustments, these systems are designed to effect changes to traffic signal timings on the order of minutes based on average flow predictions, which limits how quickly and effectively a system can respond to locally changing traffic patterns. Furthermore, centralized coordination can be also susceptible to scalability issues. For example, the network offset adjustment in ACS-Lite has been found to be intractable in real time for only 12 intersections.

To achieve greater real-time responsiveness, other work has focused on techniques for computing intersection timing plans that optimize actual traffic flows (e.g., ALLONS-D, PRODYN, OPAC, RHODES, CRONOS, and others). This class of online planning approaches, sometimes referred to as model-based optimization, often significant tradeoffs have to be made to achieve computational tractability for real-time operation in realistic planning horizons, due to the inefficiency of searching in an exponential planning search space. For these systems, decentralized operations are often not effective in road networks due to the lack of capability to work in sufficiently long horizons and to handle local mis-coordination situations. Rather, these systems are often supported using centralized and hierarchical forms of network flow control, e.g., the coordination and synchronization layers for OPAC in RT-TRACS and REALBAND for the intersection control algorithm COP in RHODES.

BRIEF SUMMARY OF THE INVENTION

Urban networks present a challenge to adaptive traffic control systems as there are multiple, and typically competing, dominant flows that shift dynamically and sometimes non-recurrently through the day in addition to having densely spaced intersections requiring tight coordination. The present invention is a scalable urban traffic control system (referred to herein as SURTRAC) addresses these challenges and offers a new approach to real-time, adaptive control of traffic signal networks. The methods and system described herein exploit a novel conceptualization of the signal network control problem as a decentralized process, where each intersection in the network independently and asynchronously solves a single-machine scheduling problem in a rolling horizon fashion to allocate green time to its local traffic, and intersections communicate planned outflows to their downstream neighbors to increase visibility of future incoming traffic and achieve coordinated behavior. Each intersection optimistically assumes that projected traffic inflows will occur when allocating its green time locally, and anticipates and reacts to mis-coordinated situations when traffic does not flow as expected. The present invention formulation of the intersection control problem as a single-machine scheduling problem abstracts flows of vehicles into clusters (queues, platoons), which enables orders-of-magnitude speedup over previous time-based formulations and is what allows truly real-time (second-by-second) response to changing conditions.

BRIEF DESCRIPTION OF THE DRAWINGS

For the present invention to be easily understood and readily practiced, the invention will now be described, for the purposes of illustration and not limitation, in conjunction with the following figures, wherein:

FIG. 8 lists the information flows in the system diagram;

FIGS. 13A-13H are logic flow diagrams of one embodiment of the present invention.

DETAILED DESCRIPTION OF THE INVENTION

Figure 3:
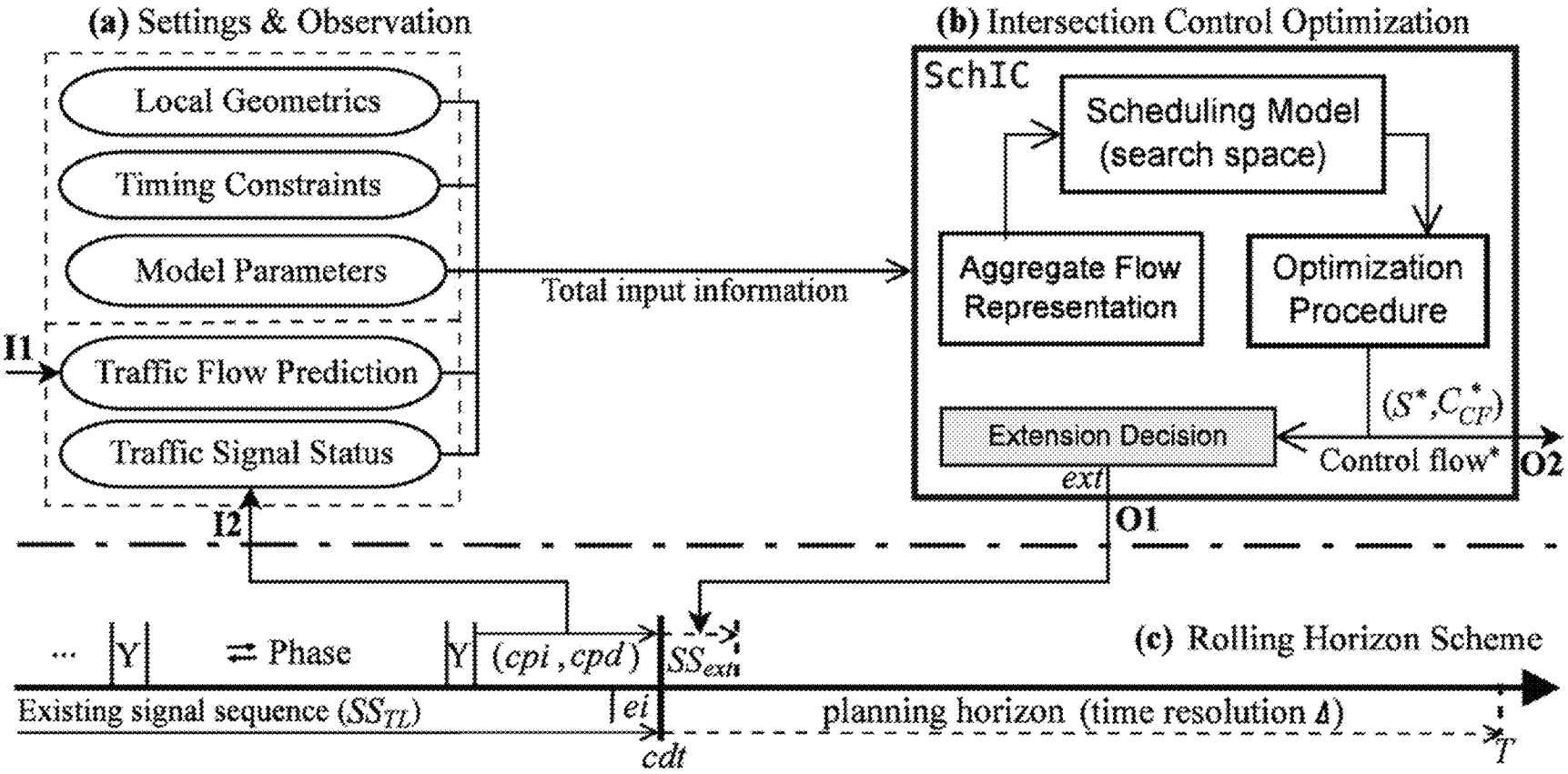
FIG. 3 illustrates one embodiment of the core intersection control optimization algorithm (b) of the present invention.

The traffic signal control problem in the present invention is formulated as a conventional schedule-driven process. To define the problem, a road network with a traffic light at each intersection is the focus. Now turning to FIG. 3 illustrating the core intersection control optimization algorithm (b) of the present invention, which uses the current inputs (a) to compute a new sequence $SS_{ext}$ to extend the existing signal sequence for the traffic controller, based on a rolling horizon scheme (c). There are two real-time inputs I1 and I2, and two real-time outputs O1 and O2. As shown in FIG. 3 block (a), the internal inputs of an intersection including static (or slowly changing) settings including local geometrics, timing constraints, and model parameters, as real-time observation including traffic flow prediction (I1) and traffic signal status (I2) at each decision time.

For each intersection, the local geometrics include a set of entry and exit roads, in which each has fixed length and a set of lanes, and the controlled intersections at the other side of the entry and exit roads are respectively upstream and downstream neighbors. Vehicles pass the intersection in a set of possible movements from entry to exit roads.

The traffic light cycles through a fixed sequence of phases I, and each phase $i \in I$ governs the right of way for a set of compatible movements. The next phase of i is next(i)=(i+1) mod|I|. For traffic signal control, a signal sequence (SS) contains a sequence of phases and associated durations. For the switching process, there are some timing constraints for safety and fairness: the yellow light after each phase i runs for a fixed clearance interval ($Y_i$), while each phase i has a variable duration ($g_i$) that can range between a minimum ($G_i^{min}$) and maximum ($G_i^{max}$).

It is assumed that each agent holds a private signal sequence $SS_{TL}$ that controls an intersection for a finite future time, which is periodically updated according to a (c) rolling horizon (as shown in FIG. 3): When the time reaches a short execution interval (ei) before the end of $SS_{TL}$ (at the next decision point), the agent computes a new sequence in a planning horizon, and uses the prefix to generate a short sequence $SS_{ext}$ to extend $SS_{TL}$, using the most recent observation in a limited prediction horizon. Note that the whole computation and related operations (e.g., interactions with the traffic light controller) should be finished in ei, and ei should always be shorter than the duration of $SS_{ext}$. The objective of the agents is to minimize the total cumulative delay of vehicles traveling through the road network over a time period.

It is assumed that all temporal values have been rounded into numbers of time steps of a discrete time resolution (Δ). For each agent, it has a prediction horizon with H time steps, and works in a planning horizon with T time steps.

Basic traffic models are also assumed. On each road, spatial distances are transformed into temporal values by dividing the average free-flow speed ($v_f$), and a queue of vehicles is discharged in a green phase at the saturation flow rate (sfr) after the start-up lost time (slt). It is assumed that turning proportions at each intersection are available. A turning proportion function tp(i,m,n) is used to provide the proportion of traffic turning from the entry road m onto the exit road n during phase i. In practice, quite accurate parameters can be estimated by using measured data.

Road flow prediction contains queuing vehicles and temporal arrival distribution of incoming traffic in a prediction horizon. In practice, the local flow prediction can be obtained by an input-output model using a stop-bar detector and advance detectors at a fixed distance ($L_m$) that counts vehicles on m. Vehicles sensed at the advance detectors are assumed to travel towards the intersection in the free-flow speed ($v_f$). The expected travel time $L_m/v_f$ provides the local prediction horizon on m. The current queue size is continuously updated according to the difference between the number of expected arrival vehicles and the actually departed vehicles at the stop bar. The prediction horizon can be extended by using planned outflows from the upstream agents.

Finally, the agent knows the current traffic signal status, including the phase index cpi and duration cpd of the currently active traffic light phase.

Schedule-Driven Intersection Control (SchIC)

At each decision time, the online planning problem faced by a given intersection agent is to produce a signal sequence $SS_{ext}$ for the next period. This is accomplished by first generating a control flow in a scheduling search space that minimizes local cumulative delay given the current observation o of incoming traffic flows, and then applying the timing constraints to obtain feasible $SS_{ext}$.

FIG. 3 shows the SchIC algorithm, which proceeds as follows. First, the traditional flow information is preprocessed into an aggregate form that captures structural information in the traffic flow. Second, a scheduling model for traffic control is formulated, in which the scheduling search space (a much smaller subspace of the traditional planning search space) is formed by using the clusters in the aggregate form. Third, for the optimization procedure, an efficient elimination criterion is proposed based on the present invention's definition of the state group, which is able to reduce the number of state updates without loss of optimality. Finally, the extension decision is implemented.

Aggregate Flow Representation

In the aggregate flow representation, vehicles in a given traffic flow are characterized as a cluster sequence $C=(c_1, \ldots, c_{|c|})$, where $|C|$ is the number of clusters in C. Each cluster c is defined as (|c|, arr, dep), where |c| is the number of vehicles in c, and arr (dep) gives the expected arrival (departure) time at the intersection respectively for the first (last) vehicle in c. The clusters in C are ordered by increasing arr values. There are two associated attributes, i.e., the expected service duration dur and the average flow rate fr, which can be used for help defining a cluster based on two equations, i.e., dur=dep−arr, and fr=|c|/dur.

The road flows entering an intersection then consist of a set of cluster sequences RF, where each $C_{RF,m}$ encapsulates the traditional flow information that contains all arriving and queuing vehicles traveling toward the intersection on entry road m. If the queue size q>0, then it is transformed into a queue cluster, which has |c|=q, arr=0, and fr=sfr, where sfr is the saturation flow rate. Each arriving vehicle with the expected arrival time arr is converted into an arriving cluster, which has |c|=1 and dur=1/sfr, where 1/sfr is the saturation time headway.

Since it is possible for more than one entry road to have the right of way in a given phase (e.g., a two-way street), and for one entry road to have the right of way in different phases (e.g., one phase for protected left turn and another for through traffic and right turn), the actual traffic flows of interest in determining a signal sequence are the inflows IF, which contain cluster sequences that combine traffic flows that can proceed concurrently through the intersection. Formally, $IF=(C_{IF,1}, \ldots, C_{IF|I|})$, where $C_{IF,i}$ contains those vehicles with the right of way during phase i. These intersection movement patterns are generally known and assumed available by existing control methods. Given the turning-proportion function tp for these movement patterns, IF can be obtained through a road-to-phase mapping, i.e., IF=RtoP (RF, tp), where flows on roads are extracted according to turning proportions and assembled into phased-based flows. The prediction horizon H remains the same after the transformation. If each road is only serviced in one phase, as in many real-world intersections, RtoP is trivial, since each inflow can be simply merged from the road flows that request the same phase.

Figure 4:
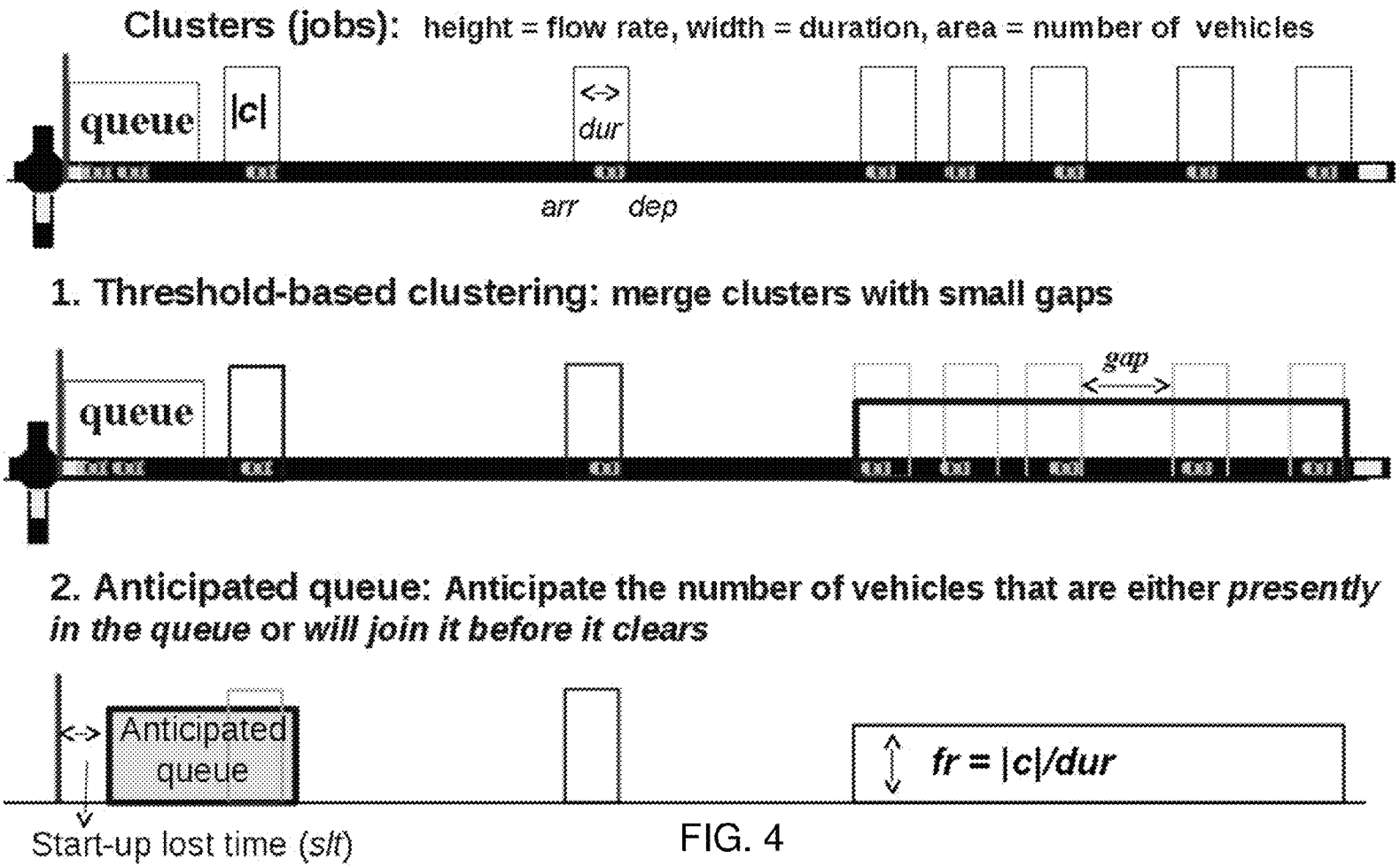
FIG. 4 illustrates one embodiment of the aggregate flow representation of the present invention.

Now turning to FIG. 4 illustrating the aggregate flow representation of the present invention. Each cluster c is represented by three attributes (|c|, arr, dep), in which |c| is the number of vehicle in c, arr (dep) gives the expected arrival time (departure time) in reference to the stop line of the intersection respectively for the first (last) vehicle in c. Clusters are ordered by increasing arr values. There are two associated attributes dur and fr, where dur is the duration between dep and arr, and fr is the average flow rate when c is serviced (by assuming the vehicles are uniformly distributed within each cluster). The two associated attributes can be used for help defining a cluster based on two equations, i.e., dur=dep-arr, and fr=|c|/dun Two aggregation techniques are considered: (1) Threshold-based clustering, which merges any clusters when the time gap between them is within a specified threshold; (2) Anticipated queue clustering, which forms an anticipated queue cluster containing the vehicles that are presently or in the future will join the queue before the existing queue clears at the intersection. As shown in FIG. 4, the flow representation can be further aggregated through use of two techniques that exploit the non-uniform nature of traffic flows. In threshold-based clustering, arriving vehicles that are within a threshold time gap ($th_g \geq 0$) are merged into a single arriving cluster. In anticipated queue clustering, vehicles that are expected to join a given queue before it is able to clear the intersection are grouped into an anticipated queue cluster.

As RtoP is applied, a road-ratio function rr(c, m) is used to store the ratio of constituent vehicles from the entry road m, for each cluster c in IF. This interface provides the necessary information for coordinating with upstream/downstream neighbors.

Scheduling Model

An alternative formulation of intersection control optimization as a scheduling problem is used, by viewing each intersection as a single machine, and each cluster in IF as a non-divisible job. In each inflow $C_{IF,i}$, the jobs can only leave the intersection in phase i, and the jth cluster can only leave after the (j−1)th one has left (i.e., the precedence constraints).

Each schedule is a feasible sequence of jobs that will pass through the intersection one by one. The straightforward representation of using a sequence of jobs, however, is not convenient for constructing a feasible schedule that satisfies the precedence constraints. Based on the fact that each job is processed in one phase and each phase services the inflow with the same index, a schedule S is represented as a sequence of inflow indices, i.e., $S=(s_1, \ldots, S_{|s|})$, where $|S|=\Sigma_{i=1}^{|I|}|C_{IF,i}|$. At the kth stage, the schedule let the kth job, which is the earliest cluster that remains in the inflow $C_{IF,s_k}$, leave from the intersection at the earliest time, under inherent traffic models and signal timing constraints, as will be realized in Algorithm 1.

For a partial schedule $S_k$, i.e., the first k elements of S, its schedule status is defined as $X=(x_1, \ldots, x_{|I|})$, where $x_i \epsilon [0, |C_{IF,i}|]$ counts the number of clusters that have been serviced for phase i. In other words, $x_i$ indicates that the first $x_i$ clusters on the ith inflow has been scheduled.

For each $S_k$, the corresponding state variables are defined as a tuple, (X, s, pd, t, d)k, where s and pd are the index and duration of the last phase, t is the finish time of the kth job, and d is the cumulative delay for all k jobs.

Algorithm 1 Calculate (pd, t, d) of $S_k$ (and obtains $c_{CF,k}$)

```
Require: 1) (s, pd, t, d) of S_{k-1}; 2) s_k
 1: i = s_k; c = (the x_i th job in C_{IF,i})
 2: if (s ≠ i) and (pd < G_s^min) then t = t + (G_s^min − pd)
 3: pst = t + MinSwitch(s, i)                    {Permitted start time of c}
 4: ast = max(arr(c), pst)                       {Actual start time of c}
 5: if (s ≠ i) and (pst > arr(c)) then ast = ast + slt_i
 6: t = ast + dep(c) − arr(c)                    {Actual finish time of c}
 7: if (s ≠ i) or (arr(c) − pst > SwitchBack(s))
 8:    then pd = t − pst else pd = pd + (t − pst)
 9: d = d + |c| · (ast − arr(c))                 {Total cumulative delay}
10: return (pd, t, d) of S_k                     {c_{CF,k} = (|c|, ast, t)}
```

The state variables of $S_k$ can be updated from those of $S_{k-1}$, where $s_k$ is known, $X_k=(X_{k-1}$ with $x_{s_k}=x_{s_k}+1)$, and (pd, t, d)k are calculated by Algorithm 1 using $(s, pd, t, d)_{k-1}$ and $s_k$. Algorithm 1 is based on a greedy realization of a planned signal sequence, where MinSwitch(s,i) in Line 3 returns the minimum time required for switching from the phase index s to i, Line 2 ensures each phase s is not shorter than the minimum $G_s^{min}$, $slt_i$ in Line 5 is the start-up lost time for clearing the queue in the phase i, and SwitchBack(i) in Line 7 is the minimum time required for the traffic light to return to the phase index i. Both MinSwitch and SwitchBack only include yellow and minimum green times during the switching process.

In the resulting control flow CF=(S, $C_{CF}$), the schedule S determines the actual flow realization $C_{CF}$, where $C_{CF}$ contains a corresponding sequence of clusters ($c_{CF,1}$, . . . , $c_{CF,|S|}$) that are reorganized from IF. For each k, all vehicles in $C_{CF,k}$ belong to $C_{IF,s_k}$. Compared to the corresponding cluster c in IF, the delay time of the kth job in $C_{CF}$ is ($ast_k$−arr(c)) (Line 9, Algorithm 1). The control flow CF for an intersection contains the results of applying a signal sequence that clears all clusters in an observation o.

Figure 5:
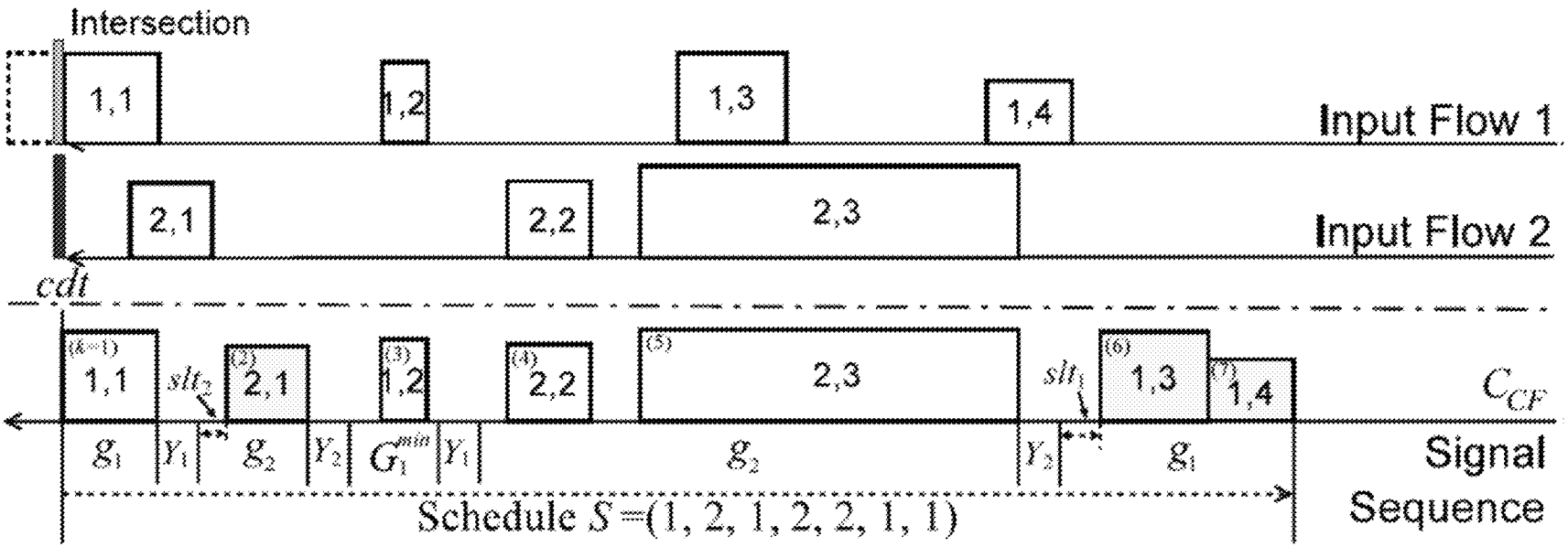
FIG. 5 illustrates a exemplary schedule of jobs (clusters), the corresponding $C_{CF}$, and a planned signal sequence.

FIG. 5 shows a schedule, a planned signal sequence, and $C_{CF}$. Note that for a given observation, a control flow might encapsulate different signal sequences due to the presence of slack time in the schedule. For example, the phase that services the cluster (2,1) might be prolonged a little without changing the cumulative delay of the control flow. This slack time can be useful for coping with uncertainty in traffic flow.

The scheduling search space is the set of all possible schedules. The planning horizon T is implicitly available as the maximum finish time of all schedules. The objective is to obtain a schedule in the scheduling search space that minimizes cumulative delay.

Figure 1:
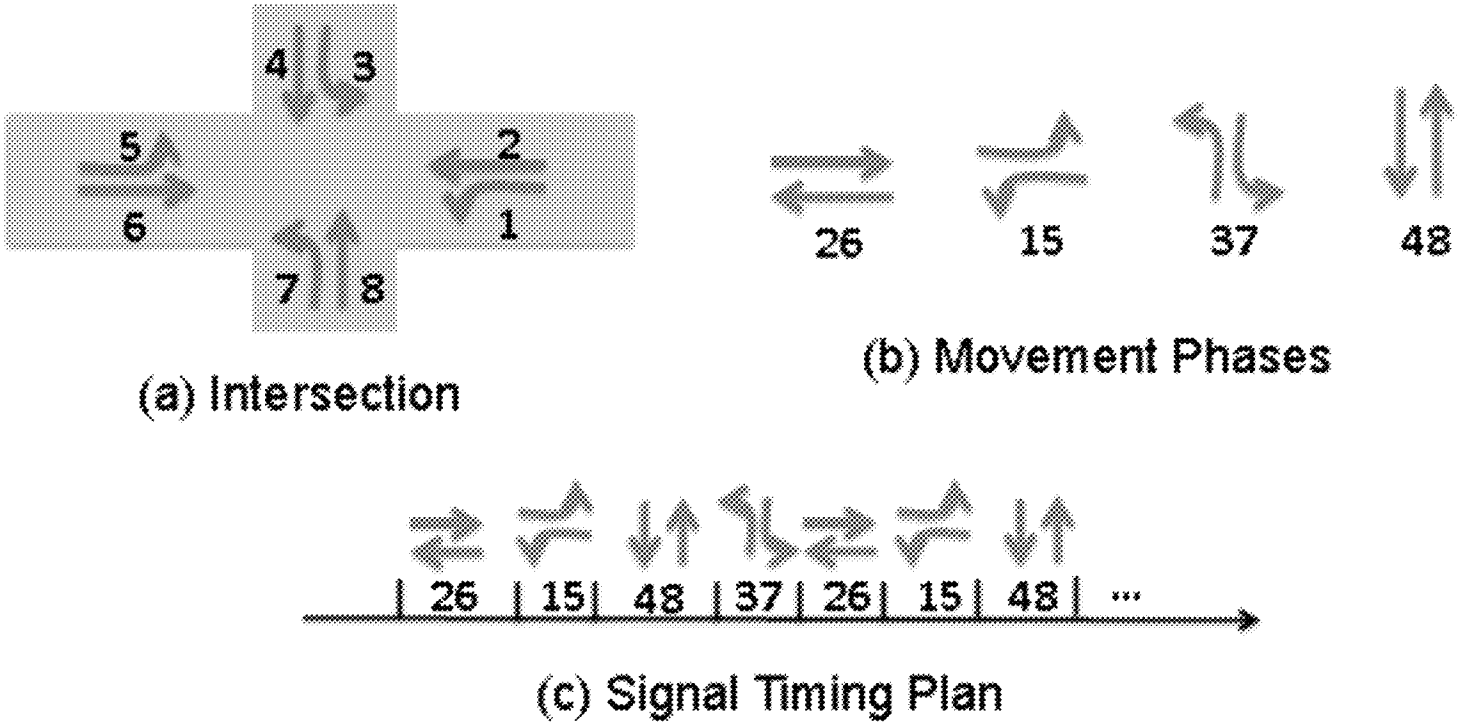
FIG. 1 illustrates examples of (a) an intersection, (b) possible movement phases and (c) a sample signal timing plan.
Figure 2:
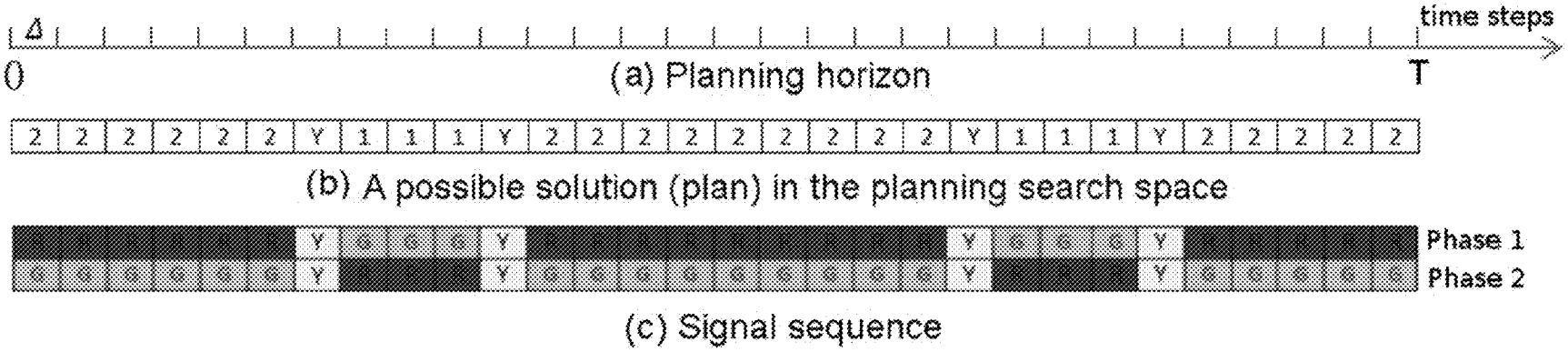
PRIOR ART FIG. 2
FIG. 2 illustrates the traditional (PRIOR ART) planning search space.

Assuming the same planning horizon, the scheduling search space is a much compact subspace of the conventional planning search space (FIG. 2) used by existing methods. FIG. 2 illustrates the traditional (PRIOR ART) planning search space. (a) the planning horizon is discretized to T time ticks, based on a fixed time resolution (Δ). (b) A possible solution (plan) example in the planning search space, for a two-phase intersection containing phase 1 and phase 2, with a clearance interval Y between the two phases. The planning search space contains all possible plans. (c) The corresponding signal sequence for phase 1 and phase 2 (R for red light, G for green light, and Y for clearance interval). In the scheduling-based formulation, vehicles are preprocessed into jobs based on the non-uniformly distributed nature of traffic flow. The rationale is to fully incorporate the domain feature that the cumulative delay is only associated with those vehicles that are delayed.

Compared to traditional single-machine scheduling problems, this scheduling model has the special features that jobs in the same inflow are subject to the precedence constraints. Furthermore, there are two nontrivial properties from the traffic control problem, i.e., the number of phases |I| is small, and the number of time steps in the prediction horizon H is limited. The planning horizon T is also polynomial in H.

Optimization Procedure

At the current decision time cdt, the current observation o is defined to contain the phase index cpi and duration cpd of the currently active traffic light phase, and the inflows IF computed for the current prediction horizon H.

Figure 6:
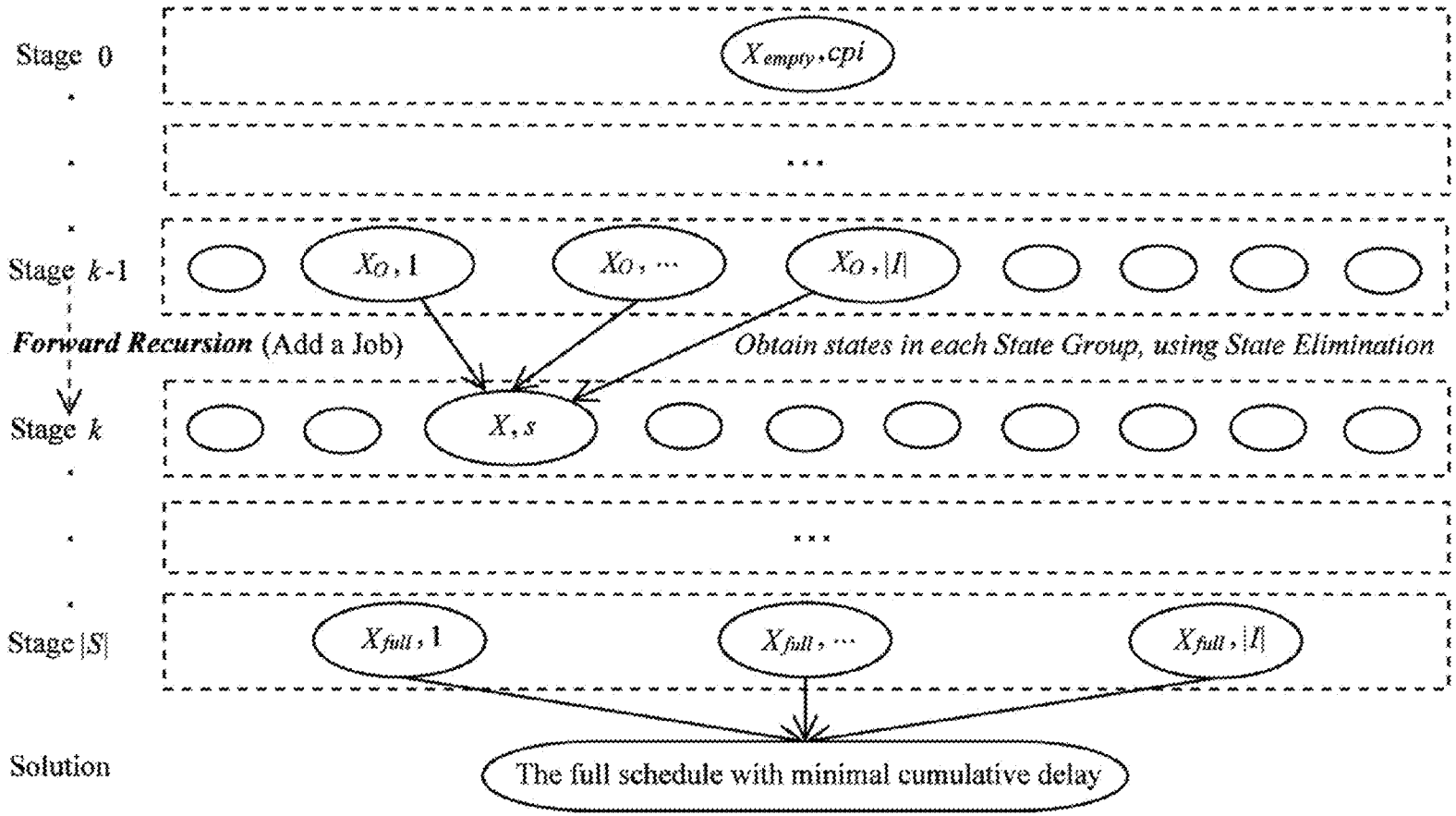
FIG. 6 describes one embodiment of the forward recursion process in the optimization procedure of the present invention.

Based on the observation o, a forward recursion, dynamic programming process (as depicted in FIG. 6) is used to obtain a near optimal solution S* among possible schedules that minimizes the total cumulative delay. FIG. 6 describes one embodiment of the forward recursion process in the optimization procedure of the present invention. The process goes through Stage 1 to |S|, by adding a feasible job at each stage. Each state group (X, s) at the k stage is calculated using the value rows in the state groups with $X_0$=(X with $x_{s_k}=x_{s_k}+1$) and s ∈[1, |I|], and only one or a few non-dominated states are kept. To retain efficiency, the states are organized into state groups. Each state group (X, s) contains all states with the same (X, s) values, only one or a few states are kept and other states in the group (or other branches in the context of a decision tree) are eliminated, decided by a StateManager (as will be used in Algorithm 3). The remaining state variables of each state in a group are stored as a value row (pd, t, d, $s_0$, $y_0$), where two additional values $s_0$ and $y_0$ are used for tracking back to the previous s and y values (as will be used in Algorithm 4). For a given state group (X, s), each row index y (or the yth value row) corresponds to a unique state, and |(X, s)| is the number of states.

For state grouping, a fundamental change here is the shift in focus from the finish time t (naturally in the planning search space) to the schedule status X (naturally in the scheduling state space). As a pattern that emerges from the scheduling model, the complement of X indicates which vehicle clusters have not left the intersection on each route, which provides more accurate structural information on traffic flow. By using X, all states in a group are fairly compared since they have no difference in remaining vehicles.

Algorithm 2 recursively calculates the value rows in all required state groups (X, s). Two unique X arrays, i.e., $X_{empty}$ and $X_{full}$, which have $x_i$=0 and $x_i$=$|C_{IF,i}|$ for ∀i, correspond to the empty and full status, respectively. Initially, only the state group ($X_{empty}$, cpi) has the value row (cpd, cdt, 0, −, −). For all other state groups (X, s), their value rows are then calculated in Algorithm 2 and stored. Using the set $\underline{X}_k$ in Line 3 is a naive way of ensuring that all input state groups are available for Algorithm 3, which adds the kth element s to possible $S_{k-1}$. The condition $x_s$>0 in Line 5 is used for ensuring the kth job is available.

Algorithm 2 Forward recursion process

1: (pd, t, d, $s_O$) of ($X_{empty}$, cpi)=(cpd, cdt, 0, -, -)
2: for k = 1 to |S| do
3: Collect the set $\underline{X}_k = \{X : \Sigma_{i=1}^{|I|} x_i \equiv k\}$
4: for ∀ X ∈ $\underline{X}_k$, $\forall_s \in [1, |I|]$ do
5: if $x_s > 0$ then Execute Algorithm 3 for (X, s)
6: end for
7: end for
8: return The solution S* by using Algorithm 4

Algorithm 3 gives the details for calculating and managing the value rows in the state group (X, s). Line 1 gives the previous schedule status$X_0$. Line 2 refers to the last phase index $s_0$ of the previous state group ($X_0$, $s_0$), and Line 3 give the row index for each previous state. Line 4 then retrieves the previous state variables ($pd_0$, $t_0$, $d_0$), and Line 5 is used for updating the state variable of the current state using Algorithm 1.

Algorithm 3 Calculate and manage value rows of (X, s)

1: $X_O$ =(X with $x_s = x_s - 1$)
2: for $s_O$ = 1 to |I| do
3: for $y_O$ = 1 to $|(X_O, s_O)|$ do
4: ($pd_O$, $t_O$, $d_O$) = (pd, t, d) in the (yo)th value row of ($X_O$, $s_O$)
5: (pd, t, d) = Algorithm 1, given ($s_O$, $pd_O$, $t_O$, $d_O$) and s
6: StateManager (X, s) ← (pd, t, d, $s_O$, $y_O$)

-continued

| Algorithm 3 Calculate and manage value rows of (X, s) |
|---|
| 7: end for |
| 8: end for |

In Line 6, StateManager maintains the value rows for each group. This is the key step where dominated states are eliminated. There are two StateManager modes: (1) The "greedy" mode only maintains an incumbent value row, and replaces it by each input value row if it has a smaller d value. (2) the "full" mode stores a complete set of non-dominated value rows. The complete set contains all value rows that are not dominated by any other value rows, based on the dominance comparison on their (t,d) values. For two value rows A and B, A is dominated by B if $t_B \le t_A$ and $d_B \le d_A$. By considering t, the "full" mode incorporates the possibility that a longer t might impose more delays on those unscheduled jobs.

For algorithm 2, the "greedy" mode has at most $|I|^2 \cdot \Pi_{i=1}^{|I|}(|C_{IF,i}|+1)$ state updates, where $|C_{IF,i}| \ge H$, and each state update in Lines 4-8 of Algorithm 3 can be executed in constant time. It is polynomial in H since |I| is limited for each intersection in real world. Note that $|C_{IF,i}|$ is normally much smaller than H. The planning horizon T is implicitly available as the maximum finish time of all schedules, which is polynomial in H but might be much larger than H in congested traffic conditions. The "full" mode has at most T times more updates than the "greedy" mode, and is optimal in the scheduling search space if T is longer than the finish time of an optimal solution.

The solution S* is tracked back using Algorithm 4. The corresponding $C^*_{CF}$ and $PD^*=(pd_1, \ldots, pd_{|S|})$ are obtained from Algorithm 1. The tuple $(S^*, C_{CF}^*. PD^*)$ is stored until it is replaced in the next scheduling iteration.

| Algorithm 4 Retrieve the solution S* |
|---|
| 1: $X = X_{full}$; $(s, y) = \arg\min_{s,y} \{d \text{ in the yth value row of } (X, s)\}$ |
| 2: for k = \|S\| to 1 do |
| 3: $s_k = s$ |
| 4: $(s, y) = (s_O, y_O)$ in the yth value row of (X, s) |
| 5: $X = (X \text{ with } x_{s_k} = x_{s_k} - 1)$ |
| 6: end for |
| 7: return $S^* = (s_1, \ldots, s_{\|S\|})$ |

Extension Decision

The role of the extension decision is to determine what initial portion of the just computed schedule ($SS_{ext}$) to append to the signal sequence ($SS_{TL}$) that is controlling the intersection. There is a basic trade-off for deciding the duration of $SS_{ext}$. A shorter duration enables quicker response to changes in flow information, whereas a longer duration leads to a more stable control flow for downstream agents.

For simplicity, the present invention only considers whether to extend the current phase or move to the next phase. An extension proposal is first made by using the first job in $C^*_{CF}$, called $c_1$, if available. There are two extension choices: 1) ext=0, if $|S^*|==0$, or $s^*_1 \ne cpi$, or if $arr(c_1) \ge SwitchBack(cpi)$ or $\min(dep(c_1)-cdt, G_{cpi}^{max}-cpd) < ext_{min}$; otherwise 2) $ext=ext_{min}$, where $ext_{min}$ is a small extension interval to favor a quick responsive capability. Here the remaining phase duration $(G_{cpi}^{max}-cpd)$ is used for satisfying the maximal green time constraints.

The traffic light then operates based on the extension proposal ext. If ext>0, the current phase is extended for ext, otherwise the current phase is terminated, and the next phase is added for a minimum green time after the yellow time.

Neighbor Coordination Mechanisms

The local observations of an isolated agent only consider vehicles that have arrived in the detection zones of the intersection's entry roads. If the entry roads are short, the prediction horizon will be short and the agent is susceptible to myopic decisions that look good locally but not globally. To counteract this possibility the above intersection control strategy is augmented with explicit coordination mechanisms.

Specifically, the present invention introduces decentralized coordination mechanisms between direct neighbors. The low overhead of this approach allows for coordination in real-time. Following the insights of existing coordination frameworks, each agent remains highly autonomous. In the present invention, the intersection control strategy always runs at the base level to tailor local action to local information. Although this setting certainly restricts possible choices, simple coordination mechanisms can still be introduced to improve the overall performance significantly.

The present invention approach includes a basic protocol and two additional coordination mechanisms. The basic protocol, similar to a social law, is defined in the sense that the basic behavior of agents will be coordinated in perfect situations. Additional coordination mechanisms are then applied to handle two nontrivial mis-coordinated situations in the network: "nervousness" and dynamic instability.

Basic Operations

Some operations are used for simplifying the description.

The operation $C \cap [t_1, t_2]$ forms a new cluster sequence that only contains (partial) clusters belonging to $[t_1, t_2]$, where a cluster is cut if it spans the boundary. If a cluster c is cut into two parts, the number of vehicles in c is divided according to the proportions of their respective durations.

The operation $(S,C) \cap [t_1, t_2]$ forms (S', C'), where $C'=C \cap [t_1, t_2]$, S' is a subsequence of S, where each element is removed if the corresponding cluster in C is totally removed.

The Unschedule($t_1$, $t_2$) operation removes the clusters in $[t_1, t_2]$ from $(S^*,C_{CF})$, and releases all corresponding (partial) clusters that are not in $C^*_{CF}$ to form a new IF.

The Shift(C,t) operation shifts the arr and dep values of all clusters in the sequence C forward in time by t.

Optimistic Non-Local Observation

For each agent, the basic protocol with its upstream agents is achieved by using an optimistic non-local observation, as shown in Algorithm 5. For each entry road m, the corresponding upstream agent UpAgent is obtained. The agent then sends each UpAgent a request message (cdt, m, $H_{ext}$), where $H_{ext}$ is the maximum horizon extension, in order to obtain a planned outflow $C_{OF}$ from UpAgent. Upon receipt of $C_{OF}$, the downstream agent adds an offset time—the average travel time between the two agents—to all the jobs in $C_{OF}$ and appends the jobs to the end of $C_{RF,m}$. Afterward, the road-to-phase mapping is applied to obtain the inflows.

Each UpAgent executes Algorithm 6 to obtain the planned outflow $C_{OF}$ at the current time cdt, based the previously planned control flow $(S^*,C^*_{CF})$. The entry road m of the requesting agent is the exit road n of UpAgent. In Line 1, $(S_{OF}, C_{OF})$ is obtained as $(S^*,C^*_{CF}) \cap [cdt, cdt+H_{ext}]$. In Line 3, rr is the road-ratio function, the function tp(i,m,n) is the proportion of traffic turning from the entry road m onto the exit road n during phase i.

Algorithm 5 Obtain an optimistic non-local observation

```
1: for Each entry road m do
2:    UpAgent = UpstreamAgent(m)
3:    Request C_OF from UpAgent using (cdt, m, H_ext)
4:    Shift(C_OF, the free travel time on the road m)
5:    Append C_OF into C_RF,m
6: end for
7: IF = RtoP(RF)                    {road-to-phase mapping}
```

Algorithm 6 Return $C_{OF}$ for a message (cdt, n, $H_{ext}$)

```
1: (S_OF, C_OF) = (S*, C_CF*) ∩ [cdt, cdt + H_ext]
2: for k = 1 to |C_OF| do
3:    TurnRatio = Σ_m(rr(c_OF,k, m) · tp(s_OF,k, m, n))
4:    |c_OF,k| = |c_OF,k| · TurnRatio
5: end for
```

For simplicity, Algorithm 5 is described as though an agent can immediately obtain each requesting result. If there are communication delays between agents, Lines 4-5 can be executed later by simply using the segment $C_{OF} \cap [cdt, \infty]$, i.e., the actual horizon extension is just shortened.

A basic property of this protocol is that non-local influences from indirect neighbors can be included if $H_{ext}$ is sufficiently long, since the control flow of direct neighbors contains flow information from their upstream neighbors. A limited $H_{ext}$ is used nonetheless to balance computational cost against the increasing uncertainty of predicted flow information over longer horizons.

The optimistic assumption that is made is that direct and indirect neighbors are trying to follow their schedules. The situation is "perfect" if all upstream neighbors produce output flows precisely according to their schedules (e.g., as when using fixed signal timing plans). Normally, the optimization capability of SchIC makes schedules quite stable, given the clusters in local observation and large clusters (platoons) in non-local observation. However, even if some neighbors change their schedules at their next decision points, those minor changes might still be absorbed by exploiting the temporal flexibility in their control flows.

Nervousness Prevention

The first situation of mis-coordination is "nervousness" for a downstream agent due to the uncertainty and disruption associated with the predictions of upstream agents that are using on-line control strategies with finite horizons.

In SchIC, maximum green constraints are not included in obtaining $(S^*, C^*_{CF})$. This simplification does not present a problem for an isolated intersection, since these constraints can be incorporated by the repair rule when determining and committing to SS. However, when operating within a network, repairs can cause nervousness for a downstream agent due to nontrivial changes between planned and actual outflows from upstream agents.

To avoid a potential disruption, all timing constraints must be incorporated into each planned signal sequence, rather than be repaired after the fact. Thus, a "nervousness" prevention mechanism, shown in Algorithm 7, is added to the coordinated control strategy of each agent. This mechanism iteratively splits clusters to ensure that all maximum green time constraints are satisfied. Based on the current observation o, SchIC is executed (Line 3) to obtain a new solution (S, $C_{CF}$, PD) for extending $(S^*, C^*_{CF})$ from the current time cdt (Line 4). Then maximum green time constraints are checked. For each stage k=1 to $|C_{CF}|$, there is a violation if $pd_k > G_{s_k}^{max}$. The violation time point $t_{vio}$ is obtained in Lines 7-8. In Line 9, $(S^*, C^*_{CF}) \cap [t_{vio}, \infty]$ are unscheduled, and IF is updated. In Line 10, $t_c$, cpi, and cpd in the observation o are updated. The process is repeated until no violation is found.

Algorithm 7 Obtain a fully feasible control flow $(S^*, C_{CF}^*)$

```
1: S* = C_CF* = Ø
2: repeat
3:    t_vio = ∞; (S, C_CF, PD) = SchIC(o)
4:    Append (S, C_CF) into (S*, C_CF*)
5:    for k = 1 to |C_CF| do
6:       if pd_k > G_sk^max then
7:          t_vio = dep(c_CF,k) − (G_sk^max − pd_k)
8:          if t_vio < arr(c_CF,k) then t_vio = dep(c_CF,k−1)
9:          Unschedule(t_vio, ∞)                {also update IF}
10:         t_c = t_vio + Y_sk; cpi = next(s_k); cpd = 0
11:         break                               {break the for-loop}
12:      end if
13:   end for
14: until < t_vio ≡ ∞ >
```

The number of iterations is equal to the number of violation time points that are found in the schedule. A time violation occurs only when a phase is scheduled to exceed the maximum green time. Given a limited planning horizon, the number of iterations is thus bounded and small.

Spillover Prevention

The second mis-coordination situation is the spillover effect. Each road in a traffic network has its arrival capacity (ac), i.e., ac=L/h, where L is the road length, and h is the average headway distance between statically queuing vehicles. The spillover due to insufficient capacity on an entry road of a downstream intersection will not only block traffic flow from upstream intersections, but might also lead to dynamic instability in a network.

The spillover prevention mechanism is used by a downstream agent to prevent a spillover in the next phase by deciding if the current phase should be terminated earlier than planned. In this mechanism, the downstream agent sacrifices its own interest for the sake of its upstream neighbors.

For the control flow $(S^*, C^*_{CF})$, all adjacent clusters that are of the same phase are merged into a macro cluster, i.e., mc=(c, PhaseIndex, SlackTime, DelayTime), where c is the merged cluster, PhaseIndex is the phase index, SlackTime is the total slack time in mc, and DelayTime gives how long the first cluster in mc will be delayed.

Three conditions are required to trigger Algorithm 8: (1) there is more than one macro cluster; (2) the PhaseIndex of $mc_1$ and $mc_2$ are respectively cpi and next(cpi); and (3) SlackTime=0 and DelayTime>0 for $mc_2$.

Algorithm 8 Prevent spillover in the next phase

```
1: c_1 = (c of mc_1); c_2 = (c of mc_2); i_n = next(cpi)
2: SOCount = 0
3: for m ∈ EntryRoadsServicedinPhase(i_n) do
4:    SOCount+ = max(0, |c_2| · rr(c_2, m)−(ac of m))
5: end for
6: if SOCount ≡ 0 return
7: t_SO = min(SOCount/sfr_in, DelayTime of mc_2)
8: t_old = dep(c_1), t_new = max(0, t_old − t_SO)
9: RQCount = |c_1| · (t_old − t_new)/t_old
10: if SOCount ≥ RQCount then
11:    Unschedule(t_new, t_old); Unschedule(dep(c_2), ∞)
12:    Shift(C_CF* ∩ [arr(c_2), dep(c_2)], t_new − t_old)
13: end if
```

If these conditions hold, Algorithm 8 is executed to prevent spillover in the next phase. The basic idea is to obtain an anticipated spillover count SOCount (Lines 2-5) in the next phase, and use the time $t_{SO}$ (Line 7) required for clearing SOCount to estimate the residue queue count RQCount (Lines 8-9) to be sacrificed in the current phase. If SOCount≥RQCount, the actual adjustment to the control flow is performed in Lines 11-12 by shifting clusters in $mc_2$ ahead to avoid spillover. For simplicity, all unscheduled clusters are discarded, although in principle these clusters might be re-scheduled using SchIC.

System Architecture

Figure 7:
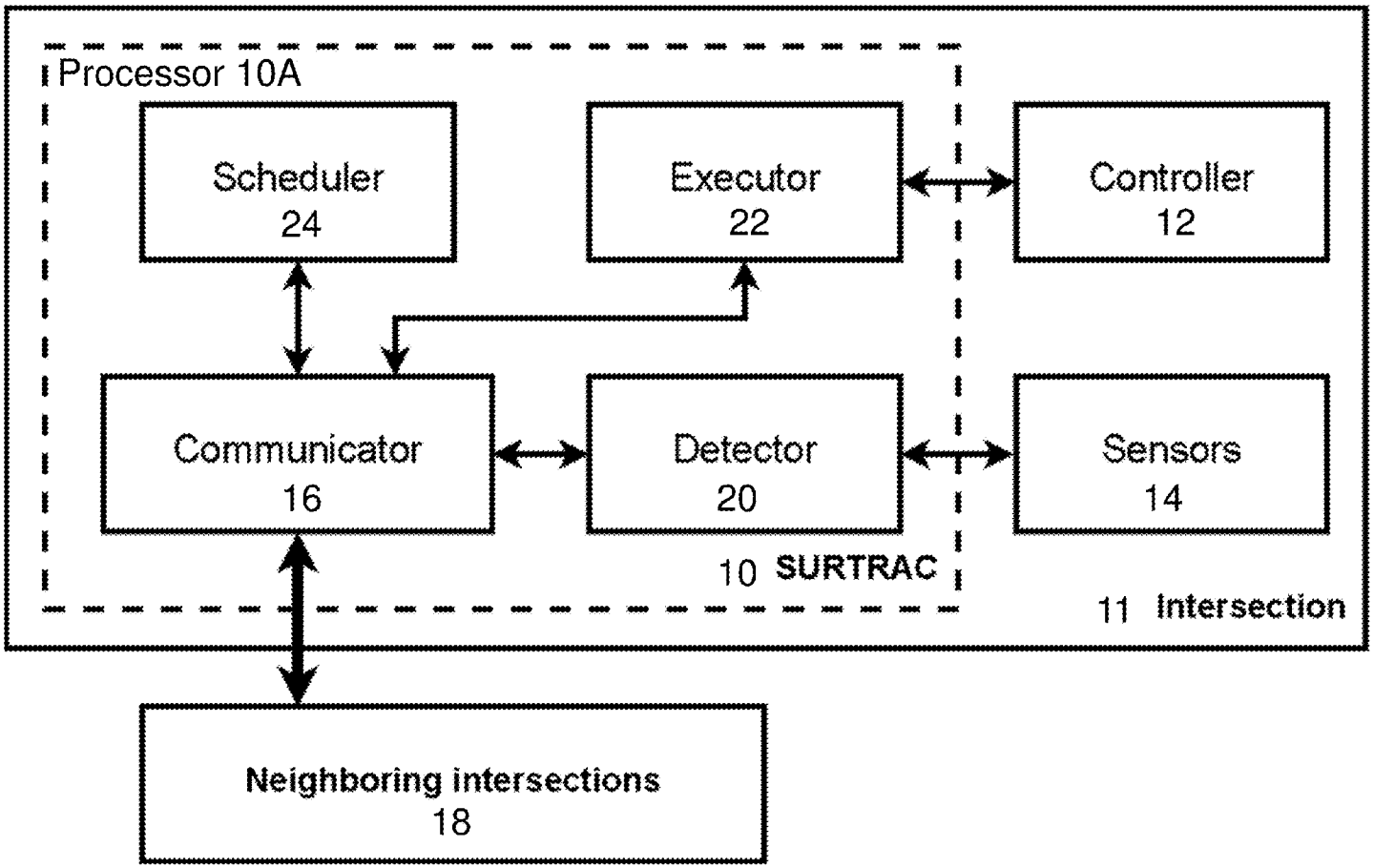
FIG. 7 illustrates one embodiment of the system diagram of the present invention.

Now turning to FIG. 7 for a schematic of the Scalable Urban Traffic Control (abbreviated as SURTRAC) system 10 that implements schedule-driven traffic control as part of a flexible signal control system designed to be easily integrated with controller 12 and sensor hardware 14 from any vendor. True to the schedule-driven traffic control model, SURTRAC 10 is organized as a completely decentralized multi-agent system having its own processor 10A (with memory) that executes computer implemented software routines residing in modules Communicator 16, Detector 20, Executor 22, and Scheduler 24 based on input from Intersection Control (or processor) 12, intersection sensors 14, and neighboring intersections adaptive traffic control processors 18. Alternatively, each module (Communicator 16, Detector 20, Executor 22, and Scheduler 24) can be independent of the other modules and contain its own dedicated processor and memory. Each intersection 11 is controlled by an agent running on an embedded computer located in the traffic cabinet for the intersection 11. The agent for each intersection 11 manages the control of the traffic signal and all of the vehicle detectors located at that intersection 11.

The agent for each intersection 11 is modeled as a multi-threaded service-oriented architecture, shown in FIG. 7. The Communicator service module 16 handles the routing of all information (as listed in FIG. 8) between different services as well as information sharing between neighboring intersections 18. The Detector service module 20 interfaces with all vehicle sensors 14, processing real-time data into messages that can be used by local and remote services. The Executor service module 22 manages the interface with the traffic signal controller 12, reading status information about the state of the traffic signals and controlling the duration and sequence of phases. The Scheduler service module 24 uses data from the other services to create schedules that allocate green time at the intersection 11. Detailed descriptions of each service are provided.

Communicator Service Module 16

SURTRAC 10 deployments rely fundamentally on connectivity throughout the road network, but by design it is only necessary for an intersection 11 to be able to communicate with direct neighbors. By keeping communication strictly between neighbors, the SURTRAC system can scale to very large signal networks. All communication is asynchronous and robust to temporary network failure.

As shown in FIG. 7, all communication is routed through the Communicator service module 16 at a given intersection 11. Most messages are routed locally. All data are encoded as messages of pre-defined types, and can be addressed to any intersection. By using standard types, Executor 22 and Detector 20 service modules that integrate hardware from different vendors can provide the same information to the rest of the system. Formally, each message can be described as a tuple<type,time,orig,dest,source,data> of the message type, the time that the message was generated, the intersection 11 where the message originated, a list of destination intersections for the message, the service or detector that created the message, and the content of the message as a JSON (JavaScript Object Notation)-encoded string.

Detector Service Module 20

The Detector service module 20 manages the interfaces with all sensors 14 located at an intersection 11. For each sensor 14, real-time data must be retrieved, encoded into a message, and then sent to the local Scheduler service module 24. If the sensor 14 functions as an advance detector for a neighboring intersection 18, then the message must also be sent to the remote Scheduler service module 20.

A wide variety of vehicle sensors 14 are currently used in traffic systems, including induction loops, video detection, and radar systems. The pilot deployment of SURTRAC described below uses Traficon video detection, but other types of detectors are substitutable. FIGS. 10*a-d* shows the placement of detectors at a typical intersection. For each exit link, a group of exit detectors is placed near the intersection. For each entry link, a group of stop-bar detectors is placed near the intersection, and a group of advance detectors is placed far away from the intersection. To maximize the look-ahead horizon, the exit detectors (for SA-M1, FIG. 8) of an upstream intersection are used as the advance detectors (for SA-I3, FIG. 8) for the downstream intersection if possible. For intersections on the boundary of the system, advance detectors usually must be located closer to the intersection. For each intersection, the local detectors (for SA-I2, FIG. 8) come from all stop-bar and exit detectors and the advance detectors on any boundary link.

At each detection location, two types of data are reported: traffic counts and occupancy time of vehicles. For the video detection in the pilot system, these two measures are generated by separate detection zones: a data zone and a presence zone. Data zones are small enough to detect gaps between vehicles during congested conditions, whereas presence zones are large enough to prevent missing vehicle occupancy information. As a vehicle passes a data zone, a message is generated and routed through the Communicator. Occupancy for all presence zones is sensed every 0.1 seconds and aggregated every second, encoded into messages, and sent the same way.

Executor Service Module 22

To control the traffic signals at an intersection, SURTRAC 10 interfaces with a traffic signal controller 12, which normally uses some combination of timing plans and simple actuation to allocate green time for the intersection. When the SURTRAC system 10 is active, the controller 12 continues to enforce maximum and minimum phase durations, transitions between phases, and other safety constraints, but SURTRAC 10 adaptively allocates the green time for the intersection. SURTRAC 10 places the controller 12 into free mode, which normally uses vehicle calls (service requests) from detectors or sensors 14 for simple actuated control. When the SURTRAC system 10 is active, the controller 12 is configured to only accept calls from SURTRAC 10, similar to some other real-time adaptive systems. Phase maximums are extended to allow longer phases, and the passage (gap) time that allows the controller to change phases is shortened to allow for quicker transitions. Such configuration changes are written at the time the SURTRAC system 10 is activated to automate the startup process. The new configuration is placed in a separate memory page within the controller 12 so that the intersection 11 can easily revert to its original state.

When the Executor service module 22 is active, it communicates frequently with the controller 12, polling for state and setting vehicle calls multiple times per second. Transitions in the controller state (SA-I1, FIG. 8)—e.g. the beginning or end of a phase—are relayed to the Scheduler. The Executor service module 22 follows the extension decisions (SA-O1, FIG. 8) provided by the Scheduler service module 24, sending calls to continue in the current phase until the scheduled phase end time, at which time the Executor service module 22 sets calls for the next desired phase. When the Scheduler service module 24 updates the schedule, it may extend the current phase by any amount greater than or equal to the minimum extension (a system parameter). The minimum extension time for the pilot was set to one second, so that the schedule could be adjusted as frequently as once per second. Although this setting was the same for all intersections in the pilot, it isn't necessary, since coordination is asynchronous. When the current phase is extended, the Executor service module 22 notifies the Scheduler service module 24 of the upcoming decision point in the schedule—the point by which a subsequent update to extend the phase must be received. For small minimum extension times, the time for the Scheduler service module 24 to make a decision may be extremely short (less than half a second), and schedules may arrive to the Executor service module 22 too late to extend the current phase. To protect against such "dropped" schedules, the Executor service module 22 uses default phase durations calculated by the Scheduler service module 24. The Executor service module 22 will only end a phase earlier than the default duration if the Scheduler service module 24 chooses to terminate the phase. The Executor service module 22 may also fall back to these phase durations in the case of prolonged sensor or network failure.

Scheduler Service Module 24

Figure 9:
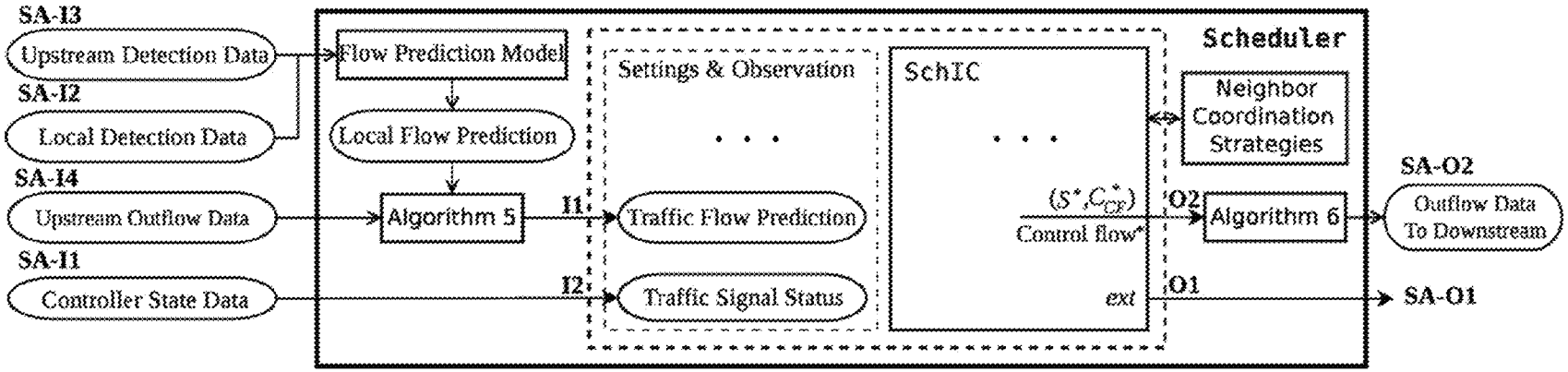
FIG. 9 illustrates the realization of the scheduler of the present invention, including the interfaces to the inputs (I1, I2) and outputs (O1, O2) of core intersection control algorithm SchIC, and the interfaces to the information flows (SA-I1, SA-I2, SA-I3, SA-I4, SA-O1, and SA-O2) in the system diagram.
Figures 10A, 10B, 10C, 10D:
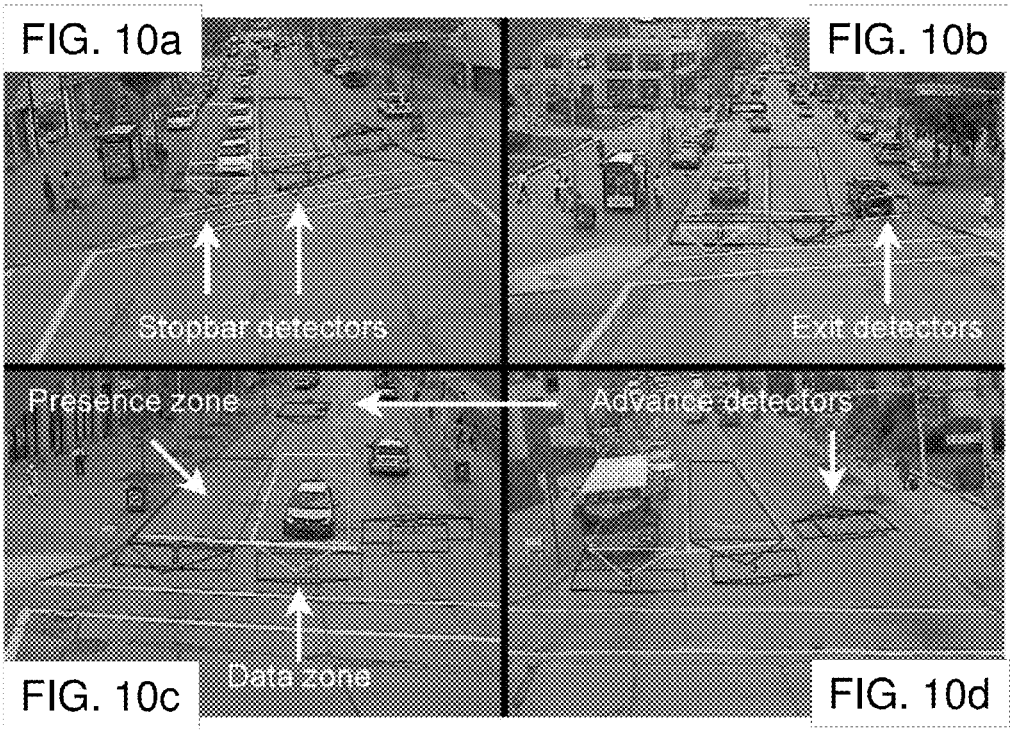
FIGS. 10*a-d* depicts examples of the placement of detectors in a typical installation of the present invention, wherein Exit detectors typically function as advance detectors for neighboring intersections downstream.

As shown in detail in FIG. 9, the Scheduler service module 24 implements the schedule-driven traffic control approach with neighbor coordination mechanisms described earlier. It continuously receives real-time phase (SA-I1, FIG. 8) and detection data (SA-I2 & SA-I3, FIG. 8) and scheduled upstream outflows (SA-I4, FIG. 8). For traffic flow prediction, it first obtains the local flow prediction on each entry road using an input-output flow prediction model, and then achieves an extended flow prediction by merging upstream outflow data using Algorithm 5. The traffic signal status is obtained using the beginning time of the currently active traffic light phase. Afterward, the schedule-driven traffic control algorithm builds its abstract model of the traffic approaching the intersection, and constructs a new phase schedule. Once a new schedule has been constructed, the extension decision ext (SA-O1, FIG. 8) is sent to the Executor service module 22 for controlling the traffic signal, and the scheduled outflows (SA-O2, FIG. 8) are sent out to downstream intersections. Some basic failure mitigation mechanisms are included to enhance reliability in the real world. These mechanisms only need to work locally due to the decentralized nature of the system.

If the network connection to a neighboring intersection 18 fails, the local intersection may not be able to receive data from advance detectors (sensors 14) or planned outflows. If the downtime is short (e.g., <20 seconds), the local scheduler service module 24 can still work properly using recent data. However, a longer failure might cause the link to be severely under-serviced since eventually no new vehicle information is received. Disconnections can be discovered quickly, since occupancy data are sent every second. For time periods with missing data, a moving average forecast is added using the current link flow rate at the stop-bar detectors. Thus, the scheduler service module 24 operates using hybrid information when look-ahead information is only available for some links. The performance of the intersection might be degraded due to the loss of predicted non-local information on disconnected links, but its other neighbors 18 will still receive good non-local information. Thus, short communication failures will not have major effects on the overall system performance.

Methods to Cope with Real World Uncertainty

One primary source of uncertainty is sensing error. Vehicles turning too sharply at an intersection can be missed by detection zones, large vehicles (e.g., trucks, buses) sometimes trigger detection zones covering multiple lanes, reflections from the road surface in inclement weather can be misinterpreted by video processing software, and so on. Disruptions to normal assumptions about traffic flows constitute a second source of uncertainty. A stopped vehicle can give the false impression of a queue that needs to be serviced, or alternatively (e.g., in the case of a one lane roadway) can be blocking a queue from being serviced despite the fact that green time is being allocated. Both types of uncertainty work against SURTRAC's attempt to optimize the flow of traffic through the signal network.

With regard to the scheduling model, the main impact of uncertainty is to lessen the accuracy of queue length estimation, which in turn misrepresents the durations of the most pressing jobs to be scheduled. Over time, queue length is dynamically maintained by a cumulative input-output technique, using departure and arrival counts obtained from stop-bar and advance detectors. However, the predicted queue length (q) is a hidden state, and detection errors can cause either over-estimation or under-estimation of q. Over-estimation of q can be seen as equivalent to insertion of buffer time, which will naturally be taken advantage of by a continual, rolling horizon scheduling approach such as SURTRAC's. However, under-estimation should be avoided, since significant delay might occur from long residual queues, and these residual queues will not be visible in subsequent scheduling cycles before they are fully cleared. The situation can become significantly worse if the queue starts to spill back to upstream intersections.

To address the problem of queue under-estimation in a pilot implementation, a set of simple heuristic strategies was adopted:

- Use of link arrival/departure ratios (ADRatio)—The ADRatio of a road segment is used to account for detection inaccuracy by hypothesizing that a road may have mid-block entrances or exits that contribute hidden flows that are not covered by any detectors. The present invention assumes that the group of stop-bar detectors will yield an accurate estimation of departing vehicles. If ADRatio<1, then some arriving vehicles have been missed, and the current counts of queued and arriving vehicles are under-estimated. Thus, when vehicles are detected at the advance detectors, the arriving vehicles count is divided by ADRatio to reclaim those missing vehicles and avoid under-estimation.
- Queue clearance management—A second strategy utilizes "elasticity" and "tolerance" measures to more effectively manage queue clearance in the presence of uncertain disruptions. The "elasticity" measure assesses the queue clearing time $t_{QC}$—necessary for identifying the queue clearance state—using the unoccupied time at the stop-line. If $t_{QC}$ is too small, a queue might be prematurely truncated. If $t_{QC}$ is too large, green time is wasted. Thus, $t_{QC}$ is defined as proportional to an elasticity ratio $r_{QC}^{ela}$, where $r_{QC}^{ela}$ is a sigmoid function on the queue size q. A long queue size will have a large $r_{CQ}^{ela}$ and will be unlikely to be truncated, reducing the risk of leaving a long residual queue, while not wasting green time identifying a short queue. "Tolerance" is applied to avoid under-estimation if a long queue is unexpectedly truncated and becomes a residual queue (e.g., due to real-world uncertainty such as a mid-block bus stop or stop-bar miscounting). The current queue is stored as q', and is derived using the cumulative input-output technique in the same way as q. Then q' is retrieved as q for the following $N_{TOL}$ scheduling cycles, where $N_{TOL}=1$ is the default tolerance size.

System Deployment

In one example, a nine-intersection pilot system was deployed in the East Liberty neighborhood of Pittsburgh, Pa. East Liberty has experienced enormous redevelopment in the past 10 years, drastically changing traffic patterns in the neighborhood. A large portion of a one-way ring road called Penn Circle was recently converted to two-way traffic during the development of a new department store. The road network in this portion of East Liberty is now a triangular grid, with three major roads—Penn Avenue, Highland Avenue, and Penn Circle—crossing each other. Already high traffic volumes are increasing with ongoing development. Competing traffic flows shift throughout the day, making coordination difficult.

Figure 11:
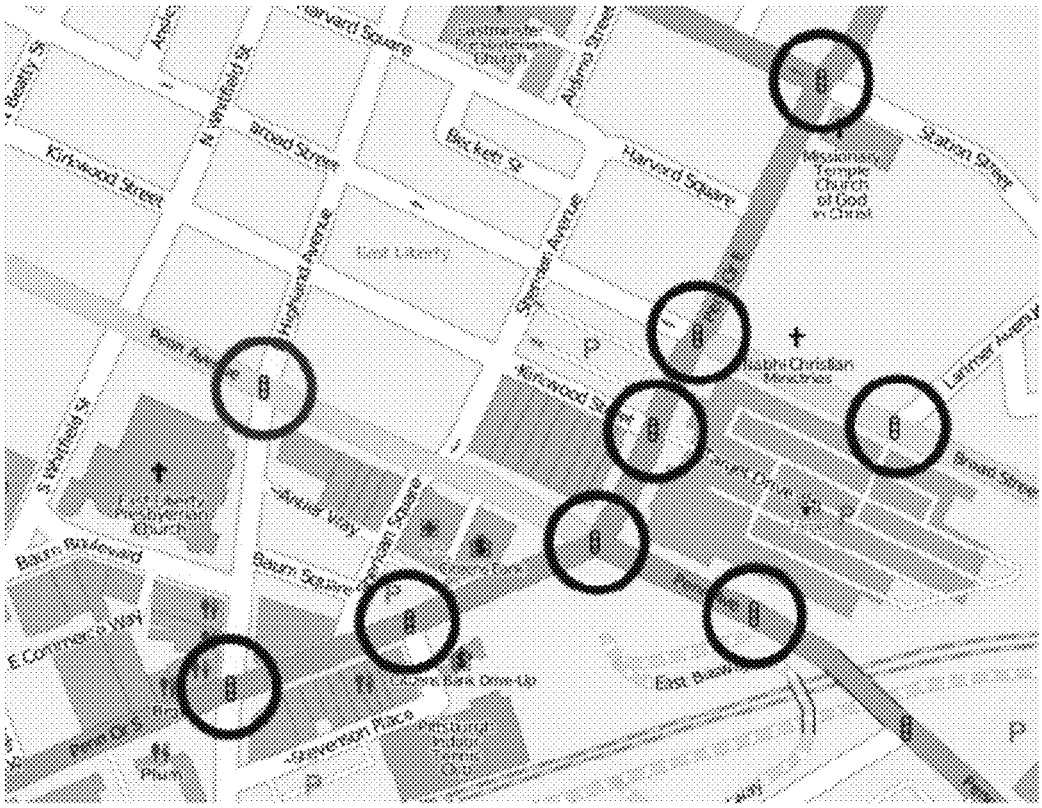
FIG. 11 illustrates the map of the nine intersection pilot site of the present invention in the East Liberty neighborhood of Pittsburgh, Pa.

The pilot site, shown in FIG. 11, consists of nine intersections. Road lengths between intersections range from 90 to 500 feet with an average of 272 feet, requiring tight coordination between intersections. Equipment at eight of these intersections—including six on Penn Circle—was updated as part of recent redevelopment. Each of these new intersections was equipped with Traficon cameras pointing in all inflow directions, and all eight were inter-connected with fiber-optic cable, providing the sensing equipment and networking infrastructure needed to deploy the SURTRAC system. The ninth intersection is located at the center of East Liberty, allowing SURTRAC to fully capture the grid network which has been returned to the area. As part of the pilot, this intersection was upgraded with cameras and joined to the existing network using Encom radios.

Prior to the introduction of SURTRAC at the pilot test site, the 8 networked intersections were controlled with coordinated-actuated timing plans during morning and afternoon rush periods and with simple actuated (free mode) control during the remainder of the day. These coordinated-actuated timing plans were generated using SYNCHO, a state-of-the-practice commercial package for offline timing plan optimization, and installed in early 2011. So arguably, this portion of the signal network was equipped with the most modern form of conventional signal control. The ninth intersection was previously controlled by a single uncoordinated, pre-timed plan.

To evaluate the performance potential of the SURTRAC system, a series of timed, drive-through runs of the pilot test site were conducted for each of two control scenarios. More specifically, the 12 highest volume routes through the pilot test site were identified and a drive through run involved a traversal of all 12 of these routes, shown in FIG. 12*a*. These routes included both directions following Penn Avenue, Highland Avenue, and Penn Circle, 3 left and 2 right turns at the intersection of Penn Avenue and Penn Circle, and the route from Broad Avenue turning left onto Penn Circle. A series of drive through runs were performed while the intersections were being controlled by the current combination of coordinated-actuated time-of-day plans and actuated free mode ("before" scenario). Then a second series of drive through runs were performed while the intersections were being controlled by the SURTRAC adaptive strategy ("after" scenario).

Figure 12B:
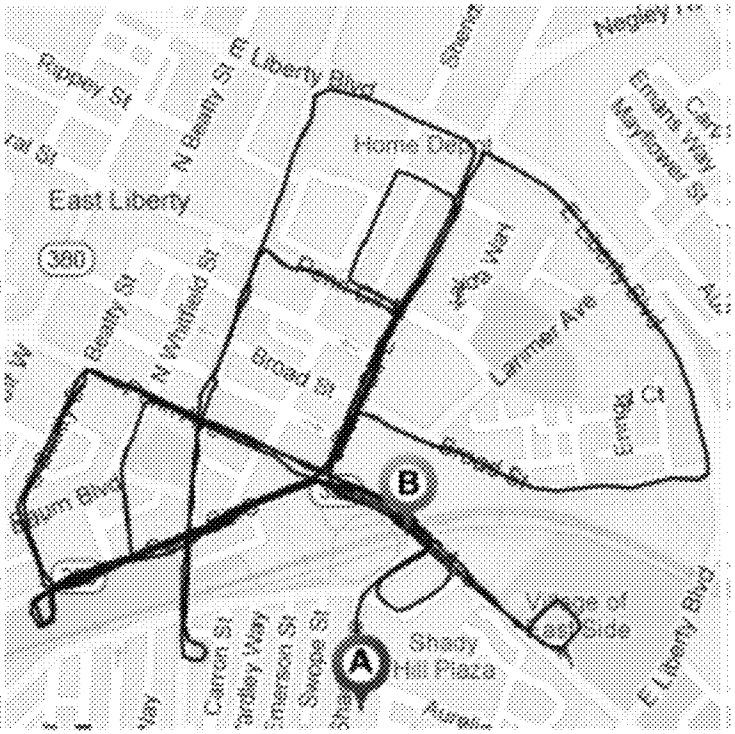
FIGS. 12*a* and 12*b* illustrate examples of the recording of GPS traces for a series of drive-through runs of the pilot test site of the present invention. Each run contained 12 routes covering all major traffic movements FIG. 12(*a*). GPS traces were post-processed to evaluate only the fixed routes through the pilot site FIG. 12(*b*)
Figure 12A:
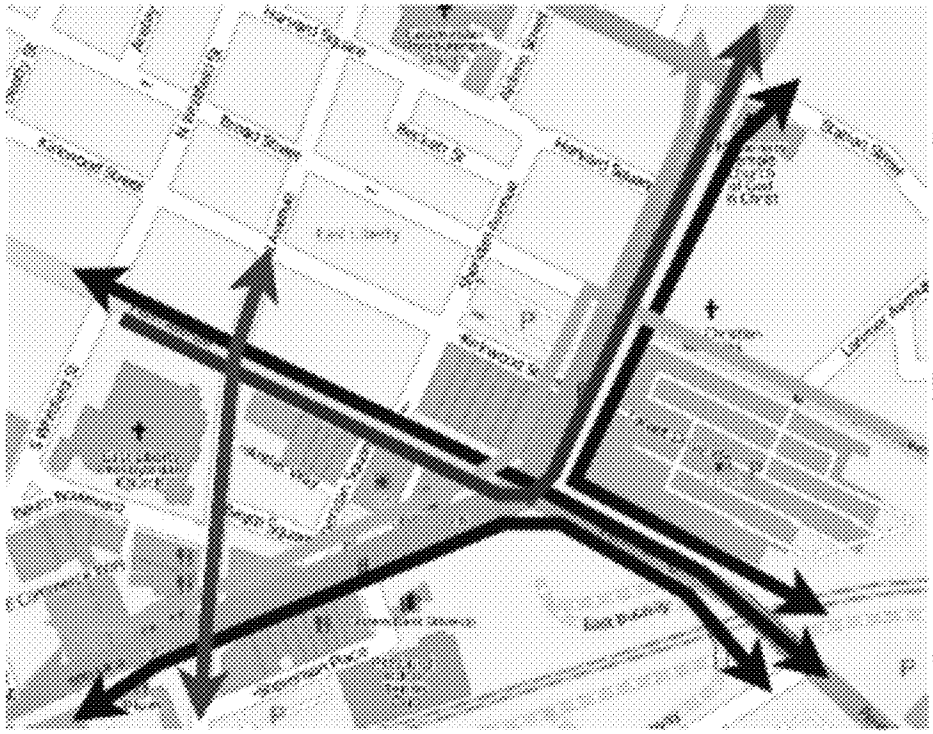

Travel data for a given run was collected through use of an iPhone app called GPS Kit Pro, which generates a GPS trace for an entire run of 12 routes. An example is shown in FIG. 12*b*. These data were then post-processed to extract only those subsequences corresponding to travel along the 12 evaluation routes, and evaluation metrics were computed from these subsequences.

For each control scenario, three evaluation runs were conducted for each of four periods of the day: AM rush (8-9 AM), Mid-day (12-1 PM), PM rush (4-6 PM), and Evening (6-7 PM). All 24 runs (12 for each scenario) were performed on weekdays other than Friday. Additionally, a fourth PM rush run was conducted for each scenario on a Friday to test this exceptionally high volume condition.

The following set of performance metrics were computed: travel time, speed, number of stops, wait time, and emissions. Travel time is normalized by canonical distances for each route to compensate for the differences in distance that arise due to GPS sampling variation in the locations of start and end points for a route. Emissions of carbon dioxide ($CO_2$), hydrocarbons, carbon monoxide (CO), nitrogen oxides ($NO_x$), and volatile organic compounds (VOC) are calculated as a function of fuel consumption. When combining data from individual routes to produce aggregate performance results, the relative volumes along different routes were used to determine weights.

Table 1 summarizes the performance improvement achieved by the SURTRAC adaptive traffic control system over the pre-existing traffic control scheme at the pilot test site. The levels of improvement are substantial across all performance metrics computed and for all periods of the day. Overall improvements are computed as a weighted average, using relative traffic volumes observed during each period (given in Table 1). With respect to efficiency of traffic flows, average travel times through the pilot site are reduced by over 25%, average vehicle speed is increased by 34%, the number of stops is reduced by over 31%, and the average wait time is reduced by over 40%. From the perspective of improving the quality of the air, which was the motivation behind the funding for this project, overall emissions are reduced by 21%.

TABLE 1

Summary of pilot test results

| Percent improvement | Average Vehicles | Travel time | Speed | Number of Stops | Wait Time | Emissions |
|---|---|---|---|---|---|---|
| AM rush | 5,228 | 30.11% | 33.78% | 29.14% | 47.78% | 23.83% |
| Mid Day | 8,007 | 32.83% | 48.55% | 52.58% | 49.82% | 29.00% |
| PM rush | 9,548 | 22.65% | 27.45% | 8.89% | 35.60% | 18.41% |
| Evening | 7,157 | 17.52% | 27.81% | 34.97% | 27.56% | 14.01% |
| Overall | 29,940 | 25.79% | 34.02% | 31.34% | 40.64% | 21.48% |

The emissions numbers reported here are computed based on the fuel consumption model given in Wallace et al. 1984—the model used by the metropolitan planning organization for the region—and EPA and EIA data.

Examining the results by period of day, the largest improvement is observed during the Mid Day period. This is explainable by the relatively high volume of traffic and the relative inability of the free mode configuration to adequately cope. During this period, performance improvement was observed with respect to all measures for eleven of the twelve routes evaluated. During the AM Rush, PM Rush and Evening periods, performance improvement was observed for eight of the twelve routes. Three of the four routes whose performance deteriorated during the AM Rush period involved traffic moving along Penn Circle, suggesting an unbalanced bias in the pre-existing SYNCHRO generated timing plan. In the highest volume PM Rush period, SURTRAC exhibited quite robust performance; of the four routes whose performance deteriorated, two performed worse on only a single metric (number of stops) and a third had lesser values for just two metrics (average speed and number of stops).

To quantify the absolute impact of SURTRAC on emissions, it is necessary to once again consider traffic volumes through the pilot test site. Given an average of 29,940 vehicles per day, Table 2 indicates projected savings in fuel and pollutant emissions. A daily savings in fuel of 247 gallons is estimated, which implies a daily reduction in emissions of 2.253 metric tonnes. Given this, an annual reduction in emissions of 588 metric tonnes is expected if SURTRAC continues to run the nine intersections at the pilot test site.

TABLE 2

Projected Emissions Savings

| Emissions | Daily (kg) | Annual (tonnes) |
|---|---|---|
| Fuel Consumption | 247 gal. | 64,580 gal. |
| Carbon Dioxide ($CO_2$) | 2213.85 | 577.82 |
| Carbon Monoxide (CO) | 17.30 | 4.51 |
| Nitrogen Oxides ($NO_x$) | 3.37 | 0.88 |
| Volatile Organic Compounds (VOC) | 4.01 | 1.05 |
| Hydrocarbons | 14.90 | 3.89 |
| Total Emissions | 2253.42 | 588.14 |

The pilot test results convincingly demonstrate the effectiveness and potential of decentralized, adaptive traffic signal control in urban road networks. In comparison to the current conventional approach to traffic control in use at the pilot test site, which involves a combination of coordinated timing plans during rush periods and actuated free mode during non-rush periods, the SURTRAC adaptive signal control system improved traffic flow efficiency through the pilot site by 25%-40% (depending on the metric considered) and reduced emissions by over 20%.

Many current approaches to adaptive traffic signal control tend to either aggregate sensed traffic flow data and coordinate network control centrally (which limits real-time responsiveness) or drive local intersection control with static, pre-computed global coordination plans. These approaches have proven most effective in arterial settings, where there is a single dominant traffic flow and traffic from side streets must be efficiently integrated. The SURTRAC system design, in contrast, aims specifically at urban road networks, where there are multiple, competing traffic flows that dynamically shift through the day. By controlling each intersection locally, responsiveness to real-time traffic conditions is maximized, and by communicating planned outflows to neighboring intersections larger corridor flows can be established on demand to match actual traffic flow volumes. Since the system operates in a totally decentralized manner, it is easily extended to incorporate additional intersections and inherently scalable to road networks of arbitrary size.

Intersection Control Flow—FIGS. 13A-13H

Figure 13A:
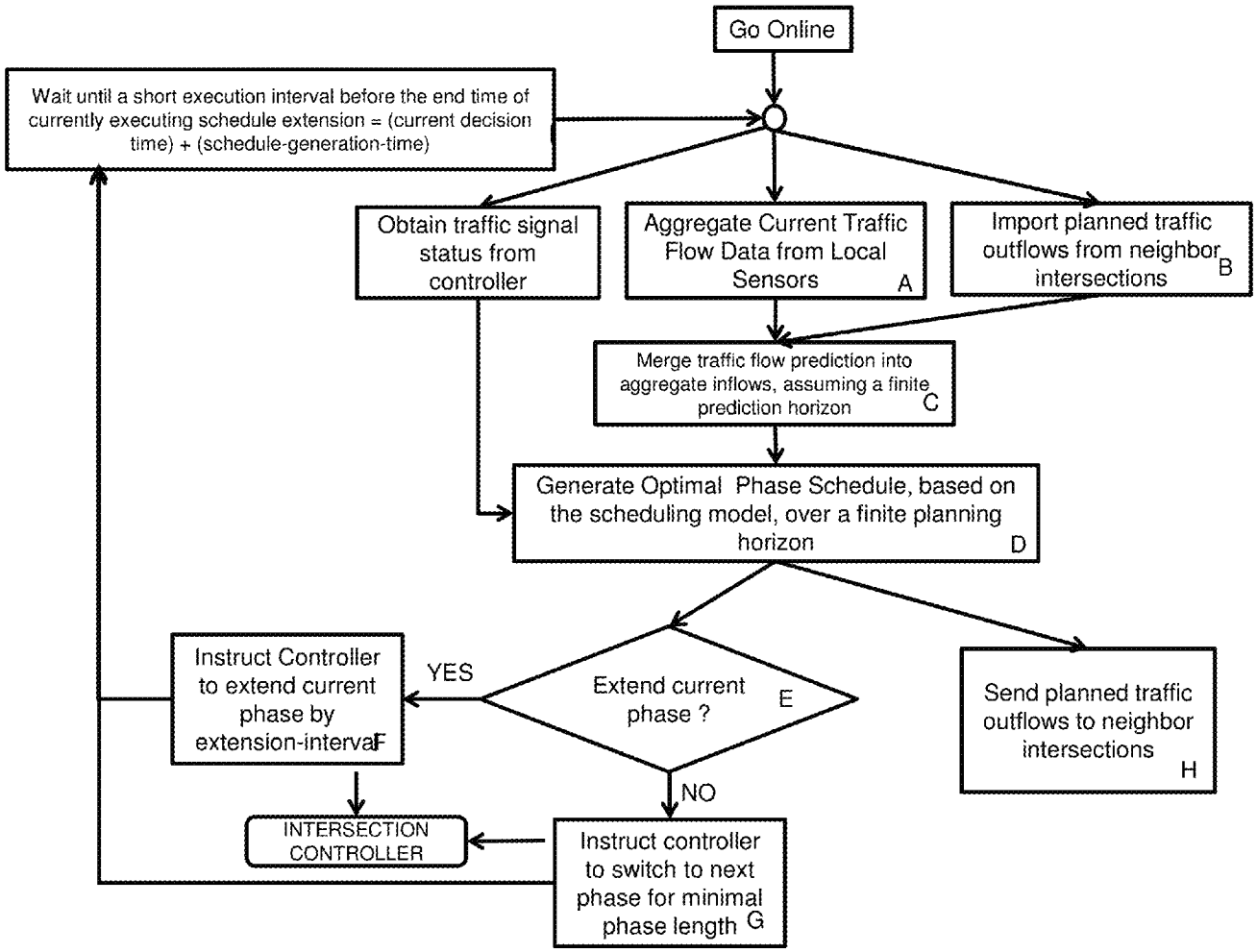
Figure 13C:
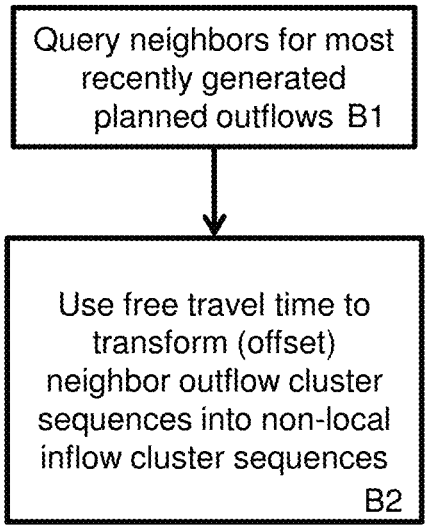
Figure 13D:
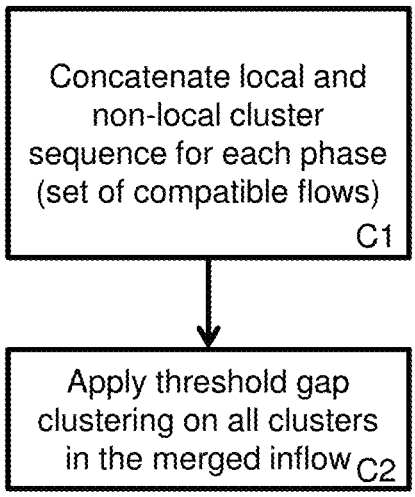

Upon the decision to take the system online, or at the beginning of the next computation cycle of the intersection scheduling procedure, Steps A and B are initiated in parallel to generate the current traffic flow prediction (FIG. 13A).

Step A constructs an aggregate representation of current traffic flows from traffic flow data that is obtained from local sensors. This is accomplished in the following two sub-steps.

Step A1 (FIG. 13B) first transforms stop bar (presence) detector data and advance detector readings (vehicle counts at fixed distance(s) from the intersection over time) into sequences of <vehicle, arrival time, departure time>triples. This is accomplished through application of free flow speed and saturation flow rate parameters to the input data. One sequence of triples is generated for each approach.

Step A2 (FIG. 13B) then aggregates the vehicle sequences generated in Step A1 into sequences of clusters (or "jobs"). A cluster is a triple of the form <vehicle-set, earliest arrival time, latest departure time>. Three forms of clustering are applied to produce the final set of cluster sequences. Compatible Phase clustering merges two vehicle sequences corresponding to compatible flows (e.g., east and west flows on a two way street) which move simultaneously in a given signal phase. Anticipated Queue clustering collapses triples at the head of a vehicle sequence that are either stopped in queue at the intersection or expected to join the queue before it can be cleared into a single cluster. Threshold time gap clustering collapses consecutive vehicle triples closer in time to each other than a fixed threshold gap parameter into a single cluster. In the example of Step A2, the first cluster groups vehicles {veh1, veh5, veh2} and is the result of Compatible Phase Clustering and Anticipated Queue Clustering, the third cluster contains vehicles {veh6, veh4, veh7} and is the result of Compatible Phase Clustering and Threshold Time Gap Clustering, and the second cluster remains the single vehicle {veh3}.

In parallel to Step A, Step B imports planned traffic outflows implied by neighbor intersection schedules. This is accomplished in the following two sub-steps.

Step B1 (FIG. 13C) first queries neighbor intersections for each neighbor's most recently generated planned outflows.

Once received, Step B2 (FIG. 13C) then uses intersection distance and free flow speed parameters (i.e., free travel time=intersection distance/free flow speed) to compute offsets and transform neighbor outflow clusters into non-local inflow cluster sequences.

Upon completion of Steps A and B, Step C (FIG. 13A) then merges locally observed and externally provided cluster sequences. This is accomplished in two sub-steps.

First, Step C1 (FIG. 13D) concatenates the local and non-local cluster sequences associated with each phase (i.e., each set of compatible flows). Each non-local cluster sequence is bounded by a finite prediction horizon H Step C2 (FIG. 13D) then applies Threshold Gap Clustering on all clusters in the merged inflow. The final set of sequences, referred to as the current set of Inflows, becomes the input to the schedule generation procedure (Step D below).

Step D (FIG. 13A) computes an optimal phase schedule for the set of Inflows that it is provided as input. This is accomplished in three major sub-steps. In a first major sub-step (consisting of sub-steps D1, D2, D3, D4—FIG. 13E) an intersection schedule is generated, based on core scheduling optimization model. Then in second and third major sub-steps, neighbor coordination mechanisms to minimize nervousness (D5—FIG. 13E) and prevent spillback (D6—FIG. 13E) are applied to adjust the schedule if necessary.

Figure 13E:
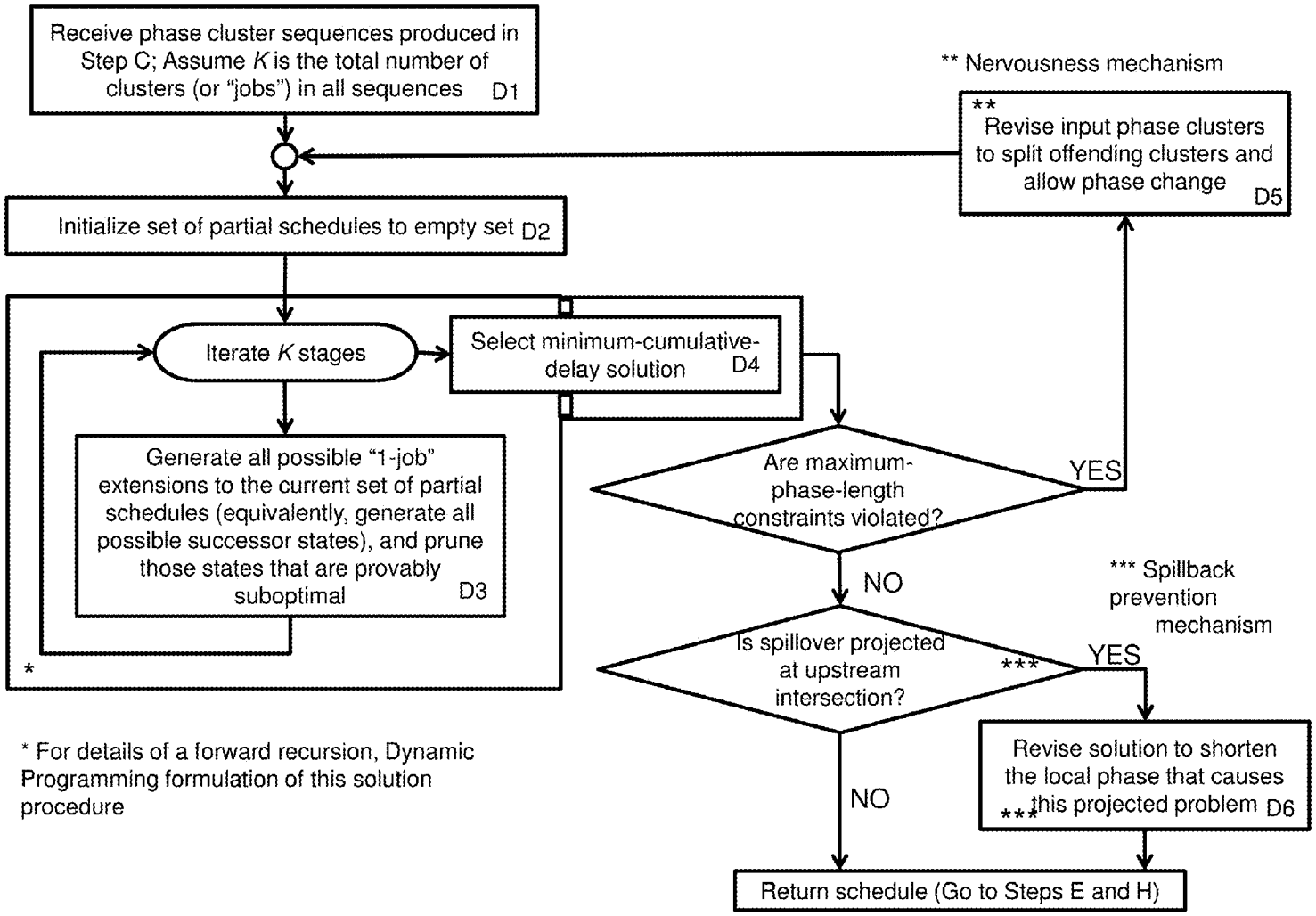
Figure 13F:
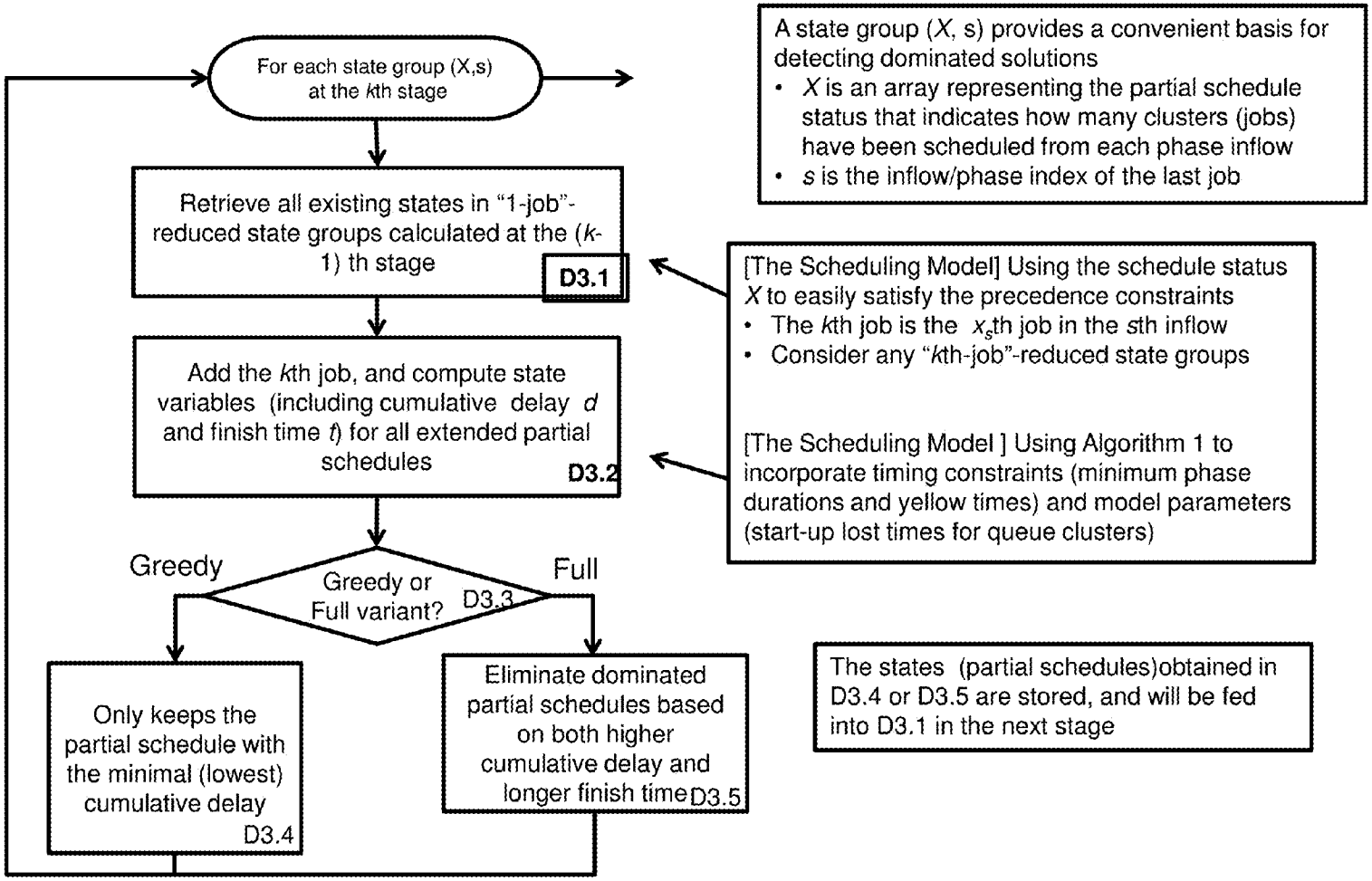
Figure 13G:
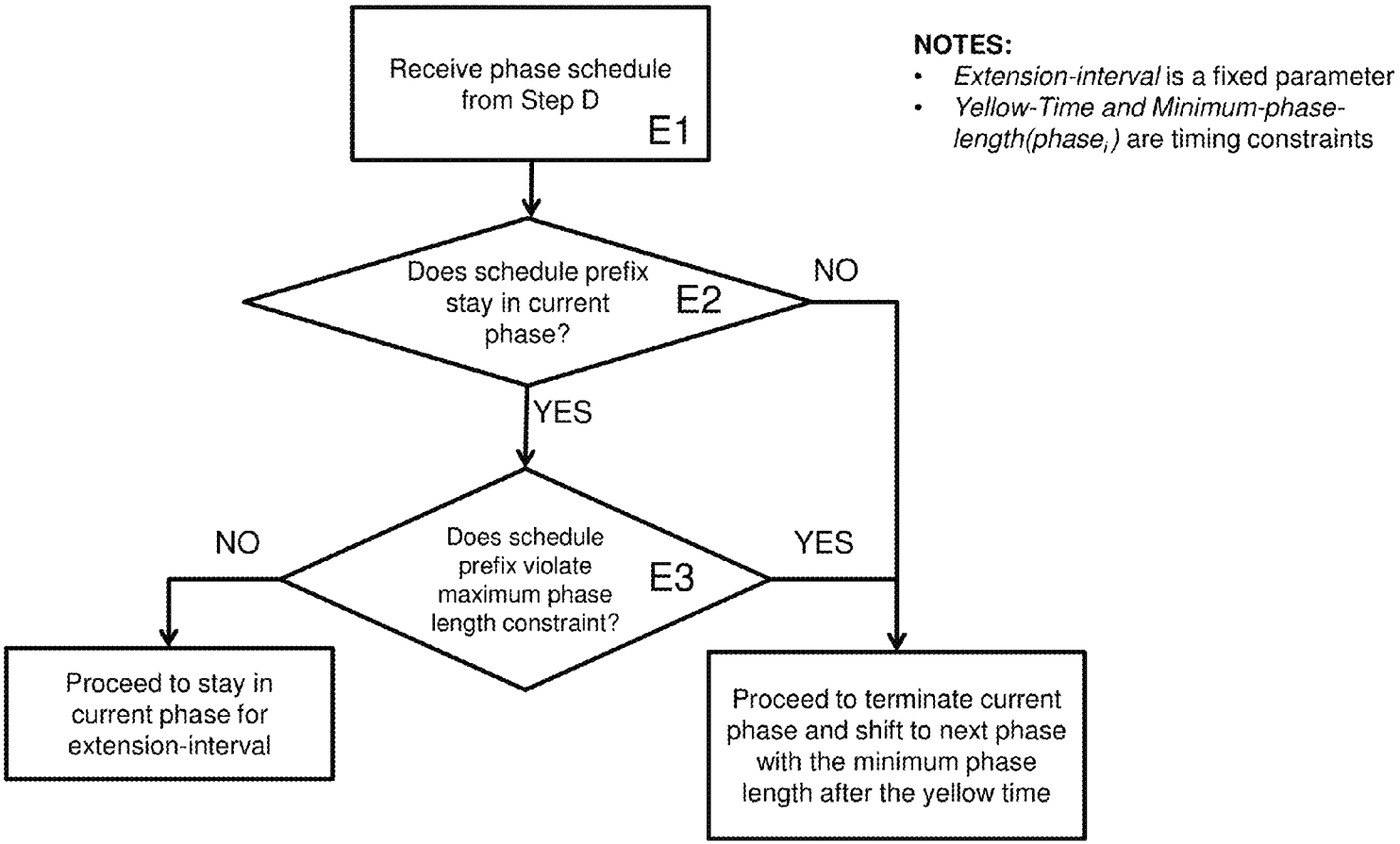
Figure 13H:
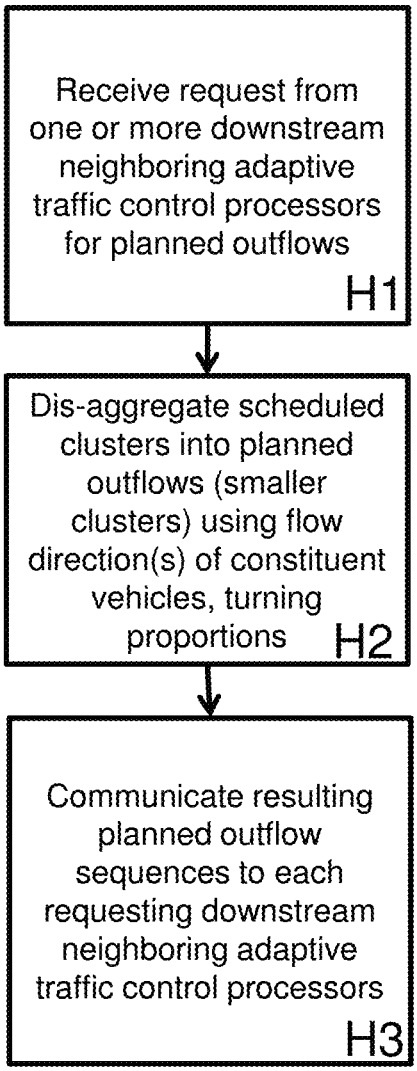

The first step to generating an intersection schedule is receiving the set of Inflow sequences in Step D1 (FIG. 13E). Let's assume that the total number of clusters in these finite-horizon sequences is K.

In Step D2 (FIG. 13E), the core search procedure is initialized; specifically the current set of partial schedules is initialized to a single empty schedule. Candidate schedules will be generated in K stages, where an additional cluster (job) is added at each stage.

During each successive stage of the search, Step D3 (FIG. 13E) is executed. Step D3 generates the set of all possible 1-job extensions to the current set of partial schedules, and then discards all candidates that are provably suboptimal. More technically, the search generates all successor states to those state groups that were generated and carried forward from the previous stage, and are "1-job"-reduced. This expansion step for each given stage is accomplished via iterative application of a sequence of five sub-sub-steps.

More specifically, the set of partial schedules are represented as a set of State Groups (X, s), where X is an array indicates how many clusters (jobs) have been scheduled thus far from each phase inflow and represents the partial schedule's status, and s is the inflow/phase index of the last job.

For each state group (X, s) at the kth stage, sub-sub-step D3.1 (FIG. 13F) retrieves all existing states (partial schedules) in the "1-job"-reduced state groups that were carried forward from previous stage k−1. Then in sub-sub-step D3.2 (FIG. 13F), the k-th job is added and associated state variables including cumulative delay and finish time are computed for all new states (extended partial schedules). Timing constraints (minimum phase durations) and model parameters (start-up lost times for queue clusters) are incorporated in this computation.

Next in the conditional construct consisting of sub-sub-steps D3.3, D3.4, and D3.5 (FIG. 13F), the expanded states generated in Step D3.2 are examined and any newly generated states (partial schedules) that can be proven to be suboptimal are pruned. The state group representation provides a convenient basis for detecting dominated solutions.

The actual determination of which partial schedules to eliminate depends on the whether the search is running in full or greedy mode. In full mode (sub-sub-step D3.5), dominated partial schedules based on both higher cumulative delay and longer finish time are eliminated. In greedy mode (sub-sub-step D3.4), only partial schedules with minimal (lowest) cumulative delay are retained.

After all K stages of the search have been carried out, the final minimum-cumulative-delay solution is selected in Step D4 (FIG. 13E).

Once the final solution is selected, it is checked to determine whether there are any maximum-phase-length constraints violated, since the schedule generation procedure considers clusters to be indivisible (non-preemptable). If yes, then a "nervousness" mechanism is applied in Step D5 (FIG. 13E) to split the offending clusters and allow the phase to change sooner. In this event, a revised set of Inflows is returned as output and the schedule generation procedure is re-invoked.

If there are no maximum-phase-length constraint violations in the schedule, then a second check is performed to determine whether the schedule implies spillover at an upstream intersection. If yes, then a Spillback Prevention" mechanism is invoked in Step D6 (FIG. 13E), which revises the solution to sufficiently shorten the local phase that causes this projected problem.

Once the schedule is generated in Step D (FIG. 13A), it is used in Step E whether to decide whether to extend the current phase or switch to the next one. This is accomplished in 3 sub-steps. After inputting the schedule in step E1 (FIG. 13G), Its prefix is examined in step E2 to determine if the phase of the first cluster is the current phase. If Yes, then a check is made to determine if the cluster violates the maximum phase length constraint (step E3). If the phase of the first cluster is the current phase and the maximum phase length constraint is not violated, then the decision is to extend the current phase for a predefined interval referred to as the extension-interval. Alternatively if the schedule prefix designates the next phase or violates the current phase's maximum phase length constraint, then the decision is to terminate current phase and shift to next phase with the minimum phase length after the yellow time.

The extension decision in Step E will lead to either Step F or Step G (FIG. 13A), each of which will retrieve the actual hardware state of the controller and then issue its respective command (call). The hardware controller, operating in free mode, will take the required action necessary for the traffic signal.

Once the hardware controller has been properly instructed, the scheduler will now wait until it is time to regenerate the schedule, since schedule generation time is typically <<than the extension interval. When the extension end time reaches a certain minimum, referred to as the schedule generation window, then the scheduler begins the next intersection scheduling cycle begins.

When a new schedule is generated in Step B (FIG. 13A), it also becomes the basis for communicating planned outflows to neighbor intersections. This is carried out in step H in three substeps. In Step H1 (FIG. 13H), a request is received from a downstream neighbor for planned outflows. In Step H2 clusters in the schedule are disaggregated into planned outflows (smaller clusters) using stored information about the flow direction(s) of constituent vehicles and model parameters (turning proportions). In Step H3, the resulting outflow sequences are then communicated.

Extended procedures to support transit and pedestrian prioritization.

The above-described invention can be generalized to enable mode-based optimization of traffic flows, in particular to provide a basis for transit and pedestrian prioritization. The generalization entails extension to both the aggregate representation of traffic flows assumed as input to the core intersection control optimization procedure and the core intersection control procedure itself.

As before, it is assumed that vehicles in a given traffic flow are characterized as a cluster sequence C=(c1, . . . , c|C|), ordered by increasing cluster arrival values arr. However, each cluster c is expanded to include vehicle mode information as follows: (|c|, arr, dep, vehicles), where vehicles is a sequence of vehicles encapsulated in the cluster also in order of arr values, and M designates the set of the vehicle mode types that are present in this vehicle cluster. Values of modes are drawn from the set of possible mode types M={bus, auto, pedestrian, truck, . . . } that are distinguishable by intersection detectors.

To properly characterize approaching any traffic flows that contain buses, it is additionally assumed that the local geometry information provided for any given intersection is extended to include the following three attributes for each entry road segment: (bs, bs-loc, bs-dwell), where bs indicates the existence (or absence) of a bus stop on this road segment, bs-loc specifies the distance of the bus stop from the intersection, and bs-dwell specifies the expected dwell time of a bus at this bus stop. If it is assumed that the intersection has interconnectivity with buses (e.g., through emerging Designated Short Range Communication (DSRC) radio technology) and has access to real-time information that is collected onboard, then bs-dwell can be learned over time as historical data is accumulated.

Extended aggregate flow representation.

Figure 14:
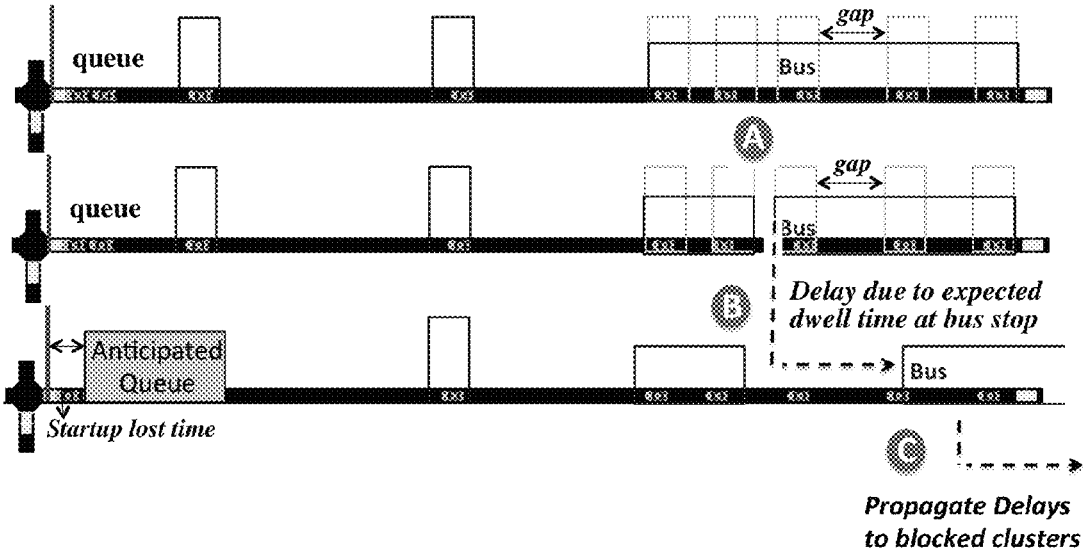
FIG. 14 illustrates one embodiment of the extended aggregate flow representation that incorporates vehicle mode and knowledge of bus stop locations along approaching intersection road segments.

Equipped with this information on the bus stops associated with this intersection, the extended procedure for generating the aggregate traffic flow representation required by the intersection control optimization algorithm is expanded as is illustrated in FIG. 14. Specifically, both threshold-based clustering and anticipated-queue-clustering are performed on the (vehicle, arr, dep, mode) input tuples provided by the intersection detectors in order of arr as before (see prior description). Once an aggregate sequence of clusters has been formed for a given entry road, clusters are next examined in order for the presence of buses. For each cluster that contains a bus that has not yet reached the bus stop associated with this intersection, the cluster sequence is revised as follows to more accurately reflect when buses will arrive at the intersection.

First, the cluster is split (possibly multiple times) into a sequence of one or more sub-clusters such that the first vehicle of each sub-cluster (except possibly the first sub-cluster) is a bus that was present in the original cluster. For the special case where the first vehicle in the original cluster is the sole bus in the cluster, the original cluster is retained. Step A in FIG. 14 illustrates one embodiment of this step.

In the second step, the intersection arrival and departure times (arr and dep) of each resulting sub-cluster are adjusted to reflect the bus's expected dwell time at the bus stop. Sub-clusters are processed in sequence order and, in the simplest embodiment, times are adjusted according to the following simple formulas: $arr=arr+bs\text{-}dwell_r$ and $dep=dep+bs\text{-}dwell_r$, for entry road r associated with this input cluster sequence. Step B in FIG. 14 illustrates one embodiment of this step. In the case where entry road r consists of only a single lane, which implies that subsequent clusters will be blocked if $bs\text{-}dwell_r$ is long enough, the same dwell time delay is propagated to subsequent clusters. Specifically, once the times of cluster $c_i$ are updated to $arr_i$ (resp. $dep_i$), cluster $c_i+1$'s times are updated to $arr_i+1=\max(dep_i, arr_i+1)$ and $dep_{i+1}=arr_i+1+fr*|c_{i+1}|$, where fr is the average flow rate and $|c+1|$ is the number of vehicles in $c_{i+1}$. The propagation stops when $arr_i+1>dep_i$. FIG. 14 Step C illustrates one embodiment of this process.

Once the above aggregate flow computation is completed, the resulting cluster sequences are merged into Inflow sequences $IF=(C_{IF,1}, \ldots, C_{IF,|1|})$ as before, where $C_{IF,i}$ contains those vehicles who have the right of way in phase i.

Priority-based intersection control procedure.

The schedule-driven optimization procedure defined above is designed to minimize the cumulative delay incurred in moving the cluster sequences IF provided as input through the intersection. The addition of mode information to the aggregate clusters that comprise these cluster sequences provides a basis for biasing the core optimization procedures by mode priority. Mode information can be incorporated in a variety of ways. One simple mechanism is to associate different weights with different modes, and schedule the clusters contained in IF to minimize weighted cumulative delay. Depending on the weights established, the resulting control behavior will be to prioritize bus or pedestrian throughput, but with continued attention to optimizing overall traffic flows.

The present invention has been described in accordance with several examples, which are intended to be illustrative in all aspects rather than restrictive. Thus, the present invention is capable of many variations in detailed implementation, which may be derived from the description contained herein by a person of ordinary skill in the art.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. An adaptive traffic control method comprising:

providing a local adaptive traffic control processor in communication with one or more neighboring adaptive traffic control processors, one or more traffic flow sensors, and a local intersection controller, wherein the local adaptive traffic control processor executes the following steps of the method:

receiving traffic signal status from the local intersection controller;

receiving current traffic flows from the one or more traffic flow sensors, wherein the current traffic flows comprises vehicle mode data;

receiving planned traffic inflows from the one or more neighboring adaptive traffic control processors;

merging the current traffic flows and the planned traffic inflows to form an aggregate traffic inflows by updating the aggregate traffic inflows with local geometry information if a bus is identified in the current traffic flows to estimate a vehicle arrival time;

generating an optimal phase schedule based on the traffic signal status and the aggregate traffic inflows;

transmitting the optimal phase schedule to the one or more neighboring adaptive traffic control processors;

determining whether to extend a current phase by an extension-interval based in the optimal phase schedule; and transmitting a switch phase instruction to the local intersection controller switch to the next phase for a minimal phase length if the current phase is not to be extended or an extend phase instruction to extend the current phase if the current phase is to be extended, wherein the extend phase message contains the extension interval.

2. The method according to claim 1, wherein the local geometry information comprises bus stop presence data, bus stop location data, and bus stop dwell time data.

3. The method according to claim 1, further comprising:

modifying the optimal phase schedule based on an objective selected from the group consisting of weighted cumulative wait-time and traffic mode prioritization.

* * * * *